US007982166B2

(12) United States Patent
Kukino et al.

(10) Patent No.: US 7,982,166 B2
(45) Date of Patent: Jul. 19, 2011

(54) CERAMIC HEATER AND METHOD FOR MANUFACTURING THE SAME

(75) Inventors: Hiroshi Kukino, Kirishima (JP); Hideaki Yoshidome, Kirishima (JP); Satoshi Tanaka, Kirishima (JP); Makoto Mido, Kirishima (JP); Masanori Ueda, Kirishima (JP)

(73) Assignee: Kyocera Corporation, Kyoto (JP)

( * ) Notice: Subject to any disclaimer, the term of this patent is extended or adjusted under 35 U.S.C. 154(b) by 1099 days.

(21) Appl. No.: 10/584,515

(22) PCT Filed: Dec. 22, 2004

(86) PCT No.: PCT/JP2004/019228
§ 371 (c)(1),
(2), (4) Date: May 15, 2007

(87) PCT Pub. No.: WO2005/069690
PCT Pub. Date: Jul. 28, 2005

(65) Prior Publication Data

US 2008/0210684 A1 Sep. 4, 2008

(30) Foreign Application Priority Data

Dec. 24, 2003 (JP) ..... 2003-428255
Mar. 29, 2004 (JP) ..... 2004-097184
Apr. 27, 2004 (JP) ..... 2004-130940
May 27, 2004 (JP) ..... 2004-158437

(51) Int. Cl.
*H05B 3/10* (2006.01)
*B28B 3/00* (2006.01)

(52) U.S. Cl. ..... 219/542; 219/553; 219/541; 219/543

(58) Field of Classification Search ..... 219/541, 219/542, 543, 544, 546, 547, 548, 552, 553, 219/460.1, 461.1, 444.1, 260, 270; 338/307–309, 338/279; 264/241; 123/145 A, 145 R; 347/206, 347/208
See application file for complete search history.

(56) References Cited

U.S. PATENT DOCUMENTS 4,556,780 A 12/1985 Atsumi et al.
4,587,402 A 5/1986 Nishino et al.
4,883,947 A 11/1989 Murase et al.
5,059,768 A * 10/1991 Hatanaka et al. ..... 219/270
5,189,280 A * 2/1993 Okazaki et al. ..... 219/270
5,304,778 A * 4/1994 Dasgupta et al. ..... 219/270
(Continued)

FOREIGN PATENT DOCUMENTS

EP 0963137 A2 12/1999
(Continued)

OTHER PUBLICATIONS

Japanese language office action and its English language translation for corresponding Japanese application 2004158437 lists the references above.

(Continued)

*Primary Examiner* — Geoffrey S. Evans
*Assistant Examiner* — Vinod D Patel
(74) *Attorney, Agent, or Firm* — DLA Piper LLP (US)

(57) ABSTRACT

A ceramic heater is provided that has a heat generating resistor and a lead member which supplies electric power to the heat generating resistor buried in a ceramic body, and exhibits excellent durability by controlling the cross sectional shape and plan configuration of the heat generating resistor.

6 Claims, 17 Drawing Sheets

U.S. PATENT DOCUMENTS

| | | | | | |
|---|---|---|---|---|---|
| 5,451,748 | A | | 9/1995 | Matsuzaki et al. | |
| 5,560,851 | A | | 10/1996 | Thimm et al. | |
| 5,753,893 | A | * | 5/1998 | Noda et al. | 219/548 |
| 5,993,722 | A | * | 11/1999 | Radmacher | 264/442 |
| 5,998,049 | A | | 12/1999 | Tanaka et al. | |
| 6,036,829 | A | | 3/2000 | Yamada et al. | |
| 6,084,220 | A | * | 7/2000 | Suematsu et al. | 219/544 |
| 6,169,275 | B1 | * | 1/2001 | Noda et al. | 219/552 |
| 6,174,462 | B1 | | 1/2001 | Oka et al. | |
| 6,218,648 | B1 | * | 4/2001 | Miyata et al. | 219/548 |
| 6,236,027 | B1 | * | 5/2001 | Miyata et al. | 219/542 |
| 6,265,700 | B1 | * | 7/2001 | Miyata et al. | 219/544 |
| 6,387,736 | B1 | | 5/2002 | Cao et al. | |
| 6,507,006 | B1 | | 1/2003 | Hiramatsu et al. | |
| 6,787,741 | B2 | * | 9/2004 | Tanaka et al. | 219/541 |
| 2001/0042746 | A1 | * | 11/2001 | Tanaka et al. | 219/541 |
| 2005/0160793 | A1 | | 7/2005 | Schumann et al. | |
| 2005/0241584 | A1 | | 11/2005 | Kachi et al. | |

FOREIGN PATENT DOCUMENTS

| | | | |
|---|---|---|---|
| JP | 06-096847 | | 4/1994 |
| JP | 06-295779 | | 10/1994 |
| JP | 07-135067 | | 5/1995 |
| JP | 09-007739 | | 1/1997 |
| JP | 09007739 | A | 1/1997 |
| JP | 10335050 | A | 12/1998 |
| JP | 11-214124 | | 8/1999 |
| JP | 11214829 | A | 8/1999 |
| JP | 2000-113964 | | 4/2000 |
| JP | 2000-113965 | | 4/2000 |
| JP | 2000183470 | A | 6/2000 |
| JP | 2000277239 | A | 10/2000 |
| JP | 2001006846 | A | 1/2001 |
| JP | 2001-052845 | | 2/2001 |
| JP | 2001-126852 | | 5/2001 |
| JP | 2001-153360 | | 6/2001 |
| JP | 2001244320 | A | 9/2001 |
| JP | 2001-313155 | | 11/2001 |
| JP | 2001-319757 | | 11/2001 |
| JP | 2002-075596 | | 3/2002 |
| JP | 2002-146465 | | 5/2002 |
| JP | 2004-095237 | | 3/2004 |
| JP | 2004-146356 | | 5/2004 |
| JP | 2004146569 | A | 5/2004 |
| WO | 03071260 | A1 | 8/2003 |

OTHER PUBLICATIONS

Japanese language office action and its English language translation for corresponding Japanese application No. 2004-097184 lists the references above.

European supplementary search report for corresponding European application No. 04807585 lists the references above.

Chinese language office action and its English translation for corresponding Chinese application No. 200480038846.9. Cited references filed on Nov. 21, 2007 and Jun. 23, 2006 respectively.

Chinese language office action and its English language translation for corresponding Chinese application 200480038846.9.

Japanese language office action and its English language translation for corresponding Japanese application 2003428255.

* cited by examiner

CERAMIC HEATER AND METHOD FOR MANUFACTURING THE SAME

BACKGROUND OF THE INVENTION

1. Field of the Invention

The present invention relates to a ceramic heater used in various applications of heating and ignition, particularly to a ceramic heater having excellent durability and a method for manufacturing the same.

2. Description of the Related Art

Ceramic heaters are widely used in various applications such as heating of various sensors, glow plug system, heating of semiconductor and ignition of kerosene burning fan heater.

There are various ceramic heaters according to applications.

For the heating element of air-fuel ratio sensor of automobile, carburetor heater for automobile, soldering iron heater and the like, for example, such a ceramic heater is commonly used that comprises a heat generating resistor made of a metal having high melting point such as W, Re or Mo incorporated in a ceramic member that is constituted from a main component of alumina as described in, for example, Patent Documents 1 through 3.

Ignition heaters of various combustion apparatuses such as kerosene burning fan heater and gas burning boilers, as well as heaters for measuring instruments are required to have durability at high temperatures. These heaters are also often used with high voltages beyond 100 V applied thereto. Accordingly, ceramic heaters made of silicon nitride ceramics as the base material and using WC that has a high melting point and a thermal expansion coefficient proximate to that of the base material is commonly used for the heat generating resistor. The heat generating resistor may also contain BN or silicon nitride powder added thereto for the purpose of making the thermal expansion coefficient thereof proximate to that of the base material of the ceramic heater (refer to Patent Document 4). Thermal expansion coefficient of the base material may also be made proximate to that of the heat generating resistor by adding an electrically conductive ceramic material such as $MoSi_2$, WC or the like to the base material (refer to Patent Document 5).

A ceramic heater made by using silicon nitride ceramics as the base material is also used in an onboard heater of automobile. The onboard heater of automobile is used as a heat source that enables it to quickly start an automobile engine in cold climate or an auxiliary heat source that assists heating automobile passenger room, and uses a liquid fuel. In an electric vehicle, limitation on the capacity of the battery requires it to decrease the consumption of electricity, and it is envisioned to use an onboard heater that uses the liquid fuel as the heat source of the passenger room heater. The ceramic heater used in the onboard heater of automobile is required to have a long service life, and to be integrated with a thermistor that senses the combustion temperature. In order to integrate the ceramic heater and the thermistor, the ceramic heater must have high durability and the change in resistance must be small over a long period of use.

Ceramic heaters may be formed in various shapes including cylinder and flat plate. A ceramic heater having cylindrical shape is manufactured by such a method as described in Japanese Unexamined Patent Publication (Kokai) No. 2001-126852. A ceramic rod and a ceramic sheet are prepared, and a paste of metal that has a high melting point consisting of a metal of one kind selected from among W, Re and Mo is printed onto one side of the ceramic sheet so as to form a heat generating resistor and a lead-out section. Then the ceramic sheet is wound around the ceramic rod with the side whereon the heat generating resistor and the lead-out section facing inside. While the operation of winding the ceramic sheet around the ceramic rod is carried out manually, the winding is tightened by means of a roller apparatus in order to achieve firm contact between the ceramic sheet and the ceramic rod (Patent Documents 6 and 7). Then the assembly is fired so as to consolidate into a nomolithic body. A lead-out section formed on the ceramic sheet is connected to an electrode pad via through hole that is formed in the ceramic sheet. The through hole is filled with an electrically conductive paste as required.

Patent Document 1: Japanese Unexamined Patent Publication (Kokai) No. 2002-146465

Patent Document 2: Japanese Unexamined Patent Publication (Kokai) No. 2001-126852

Patent Document 3: Japanese Unexamined Patent Publication (Kokai) No. 2001-319757

Patent Document 4: Japanese Patent Unexamined Publication No. 7-135067

Patent Document 5: Japanese Unexamined Patent Publication (Kokai) No. 2001-153360

Patent Document 6: Japanese Unexamined Patent Publication (Kokai) No. 2000-113964

Patent Document 7: Japanese Unexamined Patent Publication (Kokai) No. 2000-113965

SUMMARY OF THE INVENTION

Problems to be Solved

The ceramic heaters of the prior art described above do not necessarily have sufficient durability. For example, there has been increasing demand for the ceramic heater that has the capability to quickly heating up and quickly cooling down. Large ceramic heaters used in hair dressing iron or soldering iron, in particular, are subject to high stress caused by difference in thermal expansion coefficient between the heat generating resistor and ceramic material, which may cause cracks in the ceramic body thus leading to lower durability and/or wire breakage.

In the case of a ceramic heater such as ignition device that is used at a high temperature under a high voltage, insulation breakdown of the ceramic heater is a potential problem. As it is required recently to make the ignition device smaller in size and higher in igniting performance, it is necessary to apply a voltage higher than 100 V so as to achieve a temperature of 1100° C. or higher. Also as the ignition devices become smaller in size, the distance between the heat generating resistor and the lead-out section becomes so small that insulation breakdown of the ceramic heater is more likely to occur.

With the background described above, an object of the present invention is to provide a ceramic heater that has higher durability with lower possibility of cracks and insulation breakdown taking place.

Measures to Solve the Problems

In order to achieve the object described above, one aspect of the present invention provides a ceramic heater comprising a heat generating resistor buried in a ceramic body, wherein the angle of the edge of said heat generating resistor is 60° or less in at least a portion of said heat generating resistor, when viewed from a cross section perpendicular to the longitudinal direction of said heat generating resistor.

The inventors of the present application found that concentrated stress occurs in the edge of the heat generating resistor when the ceramic heater is repeatedly subjected to quick heating and quick cooling. The thermal stress on the edge of the heat generating resistor can be mitigated so as to improve the durability of the ceramic heater by making the angle of the edge in at least one place of the heat generating resistor to 60° or less when viewed from a cross section perpendicular to the direction of wiring the heat generating resistor. That is, when the angle of the edge of the heat generating resistor is controlled to 60° or less, not only the amount of expansion of the edge becomes smaller when the heat generating resistor heats up to a high temperature, but also the amount of heat generated from the edge of the heat generating resistor becomes smaller. As a result, even when heat dissipation from the ceramics that surrounds the heat generating resistor is insufficient, concentration of stress in the edge of the heat generating resistor can be avoided. This makes it possible to prevent cracks and wire breakage from occurring when the ceramic heater is repeatedly subjected to quick heating and quick cooling. In the case of a heat generating resistor that is formed in a meandering wiring pattern in plan view, heat dissipation from the heat generating resistor is particularly significant at bending portions of the wiring pattern. Thus durability of the ceramic heater can be improved further by controlling the angle of the edge of the heat generating resistor to 60° or less at the bending portions of the heat generating resistor.

It is preferable that the ceramic heater of the present invention contains a metal component that has area of proportion in a range from 30 to 95% of the cross section of the heat generating resistor. This makes it possible to mitigate the thermal stress caused by the difference in thermal expansion coefficient between the heat generating resistor and the ceramic body and improve the durability.

The ceramic heater of the present invention is preferably formed in such a structure as the ceramic body comprises a stack of at least two inorganic materials. For example, the ceramic body can be made by forming the heat generating resistor on a ceramic sheet made of an inorganic material and hermetically sealing the heat generating resistor by means of another inorganic material. In this way, the heat generating resistor can be sealed after being fired. Accordingly, durability can be maintained while enabling it to adjust the resistance of the heat generating resistor by trimming it. At least one of the inorganic materials that make contact with the heat generating resistor preferably contains glass as the main component. A ceramic body of three-layer structure can be formed by once melting glass that is applied to the ceramic sheet surface having the heat generating resistor formed thereon, deaerating the glass and putting another ceramic sheet thereon. Such a ceramic body of three-layer structure enables it to make a ceramic heater having high durability. In order to improve the durability further, it is preferable to keep the difference in thermal expansion coefficient between the inorganic materials to within $1\times10^{-5}$/° C.

With a ceramic heater of another aspect of the present invention, the heat generating resistor is buried in a meandering pattern in the ceramic body in order to effectively prevent insulation breakdown of the ceramic heater from occurring, and electric field of 120 V/mm or lower intensity is generated between adjacent runs of the heat generating resistor when a voltage of 120 V is applied to the heat generating resistor. The electric field generated between adjacent runs of the heat generating resistor can be decreased by, for example, setting the distance between adjacent runs of the heat generating resistor on the side of larger potential difference larger than the distance between adjacent runs of the heat generating resistor on the side of smaller potential difference. This enables it to suppress insulation breakdown of the ceramic heater from occurring. It also leads to less variability in the resistance over a long period of use and enables reliable ignition, while making it easier to integrate the ceramic heater with a thermistor. The distance between adjacent runs of the heat generating resistor is preferably changed continuously.

In order to effectively prevent insulation breakdown of the ceramic heater from occurring, the distance between the heat generating resistor and the lead section through which electric power is supplied to the heat generating resistor is preferably 1 mm or larger. Insulation breakdown of the ceramic heater often starts at the end of the lead section on the heat generating resistor side and proceeds through the end of the meandering portion of the heat generating resistor. Therefore, durability of the ceramic heater can be improved by setting the distance between the heat generating resistor and the lead section through which electric power is supplied to the heat generating resistor to 1 mm or larger.

When the width of the ceramic heater is 6 mm or less and distance X between adjacent wires in the lead section is in a range from 1 to 4 mm, it is preferable to form the heat generating resistor and the lead section so that X and distance Y between the heat generating resistor and the lead section satisfy a relation of $Y \geqq 3X^{-1}$. This makes it possible to improve the durability of a compact ceramic heater and prevent insulation breakdown from occurring when a high voltage is applied thereto.

In case a hottest portion of the heat generating resistor reaches a temperature of 1100° C. or higher, temperature difference between the end of the turnover section of the heat generating resistor on the lead section side and the end of the lead section is preferably 80° C. or higher.

The heat generating resistor may also have such a configuration as a portion in one turnover section of the heat generating resistor on the lead section side has a sectional area larger than that of the other portions. This configuration enables it to further improve the durability of the ceramic heater.

In case the heat generating resistor and a lead pin that is connected to the heat generating resistor are provided inside of the ceramic body that contains carbon, it is preferable to control the carbon content in the ceramic body in a range from 0.5 to 2.0% by weight. Carbon may be added to the ceramic body for the purpose of reducing $SiO_2$ that may cause migration in the ceramic body. Addition of carbon makes the melting point of grain boundary layer of the ceramic body higher, thereby suppressing the migration from occurring in the ceramic body. However, higher carbon content may cause carburization of the lead pin on the surface thereof and make it brittle. The brittle surface layer does not increase the resistance of the ceramic heater or affect the initial characteristics thereof. However, as heating operations are repeated, the lead pin repeats expansion and contract and eventually leads to breakage. As the onboard heater of automobile is required to ignite quicker in recent years, some ceramic heaters are supplied with more wattage of electric power with higher voltage applied for heating up. This practice increases the heat generated from the lead pin and makes the lead pin prone to breakage due to expansion and contract. By controlling the carbon content in the ceramic body in a range from 0.5 to 2.0% by weight, it is made possible to prevent the lead pin from breaking due to carburization of the lead pin on the surface thereof while effectively suppressing the migration due to the presence of $SiO_2$. As a result, the ceramic heater of excellent durability can be made. Also it is made possible to provide the ceramic heater that experiences less variability in the resistance and achieves reliable ignition over a long period of use.

It is preferable that diameter of the lead pin is 0.5 mm or less, and carburized surface layer of the lead pin has mean thickness of 80 μm or less. Crystal grain size of the lead pin is preferably 30 μm or less.

According to the present invention, it is made possible to provide a ceramic heater that exhibits excellent durability in such applications as the temperature is raised or lowered rapidly, or the device is used at a high temperature under a high voltage.

DESCRIPTION OF REFERENCE NUMERALS

Figure 1A:
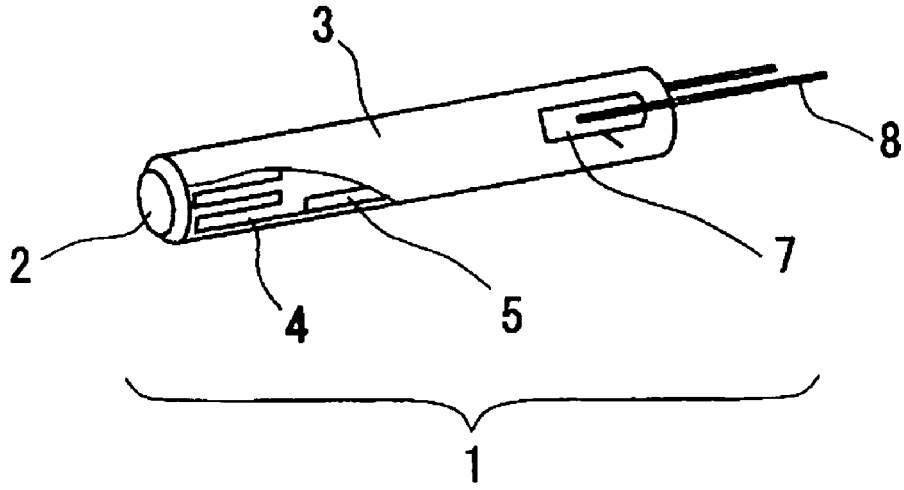
FIG. 1A is a perspective view of a ceramic heater according to a first embodiment of the present invention.

1, 50: Ceramic heater
2: Ceramic core member
3: Ceramic sheet
4, 34, 53, 63: Heat generating resistor
5, 35: lead-out section
54, 64: Lead section
55, 65: Electrode lead-out section
6: Through hole
12, 13, 32*a*, 32*b*, 52*a*, 52*b*: Ceramic sheet
18, 38, 59: Lead member
33: Sealing member

DETAILED DESCRIPTION OF THE INVENTION

Embodiments of the present invention will now be described below by making reference to the accompanying drawings.

First Embodiment

Figure 1B:
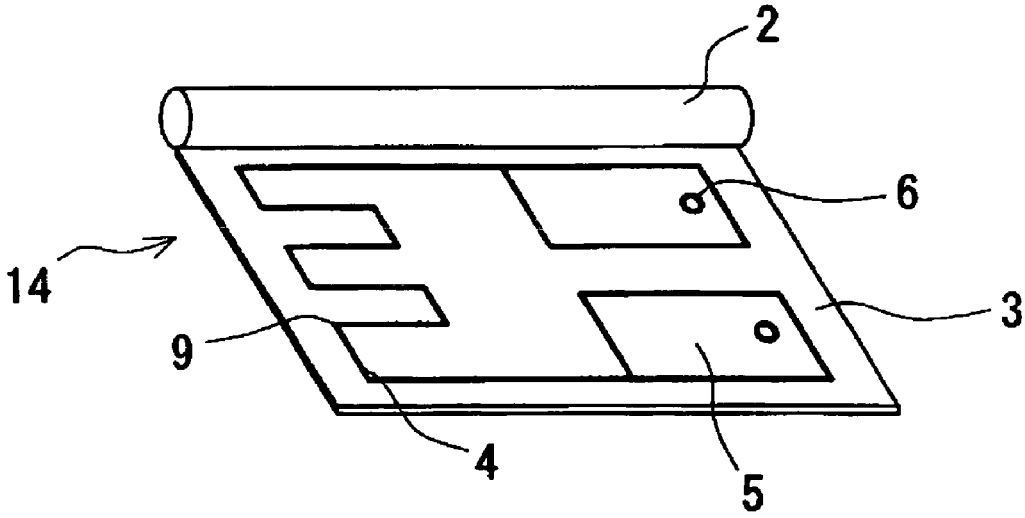
FIG. 1B shows components of the ceramic heater shown in FIG. 1A before being assembled.

This embodiment will be described by taking a ceramic heater used in a hair dressing iron or the like as an example. FIG. 1A is a perspective view of a ceramic heater according to first embodiment of the present invention, and FIG. 1B is a diagram thereof before assembly. As shown in FIG. 1A, the ceramic heater 1 has such a structure as a ceramic sheet 3 is wound around a ceramic core member 2. The ceramic sheet 3 has a heat generating resistor 4 and a lead-out section 5 formed thereon. The lead-out section 5 formed on the ceramic sheet 3 is connected through a through hole 6 with an electrode pad 7 that is formed on the back surface of the ceramic sheet 3. As shown in FIG. 1B, the ceramic heater 1 can be made by winding the ceramic sheet 3, that has the heat generating resistor 4 and the lead section formed thereon, around the ceramic core member 2 with the heat generating resistor 4 facing inside, and firing the assembly so that both members make close contact with each other. While the ceramic heater 1 is made by firing the heat generating resistor 4 and the ceramic members at the same time, lead wire 8 may be connected to the electrode pad 7 by brazing as required.

The heat generating resistor 4 is formed in a meandering pattern as shown in FIG. 1B. The lead section 5 is formed with such a width as resistance becomes about one tenth of the resistance of the heat generating resistor 4. It is a common practice to form the heat generating resistor 4 and the lead-out section 5 at the same time by screen printing or the like on the ceramic sheet 3 in order to simplify the manufacturing process.

Figure 2:
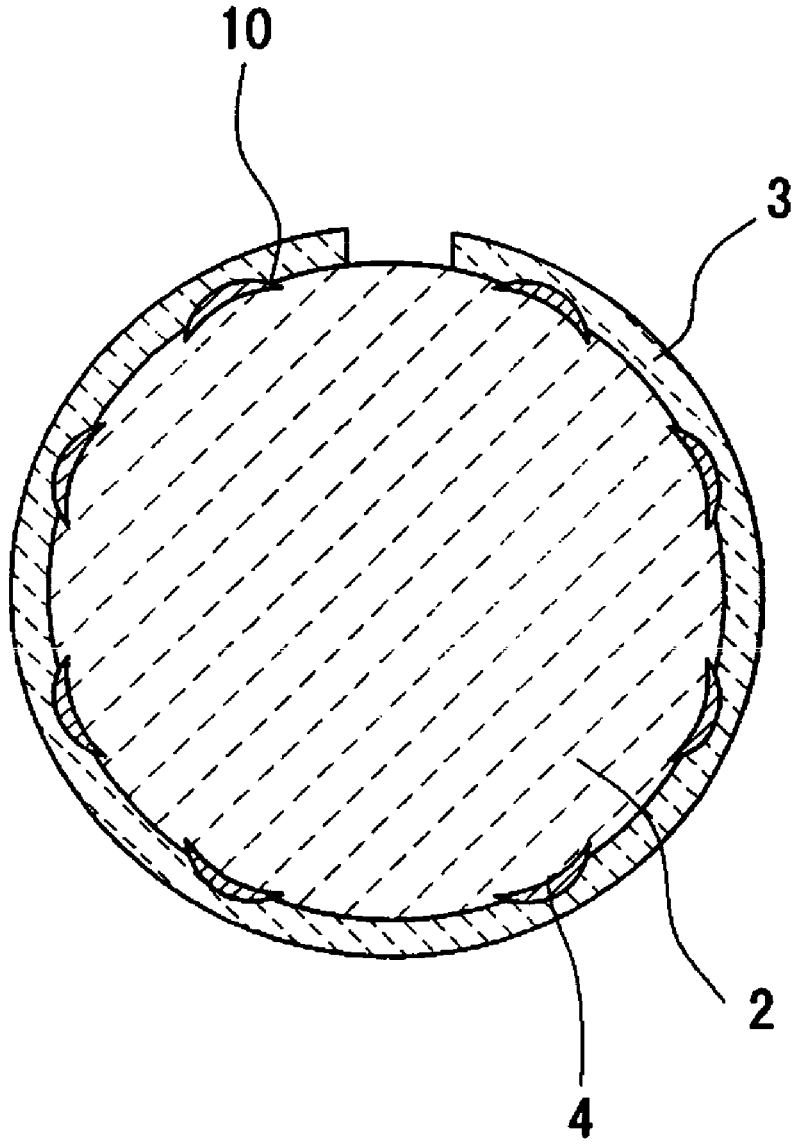
FIG. 2 is a sectional view of the ceramic heater shown in FIG. 1A.

This embodiment is characterized in that the heat generating resistor 4 is formed in such a configuration as at least one portion of the edge thereof is tapered. FIG. 2 is a sectional view schematically showing a cross section that is perpendicular to the longitudinal direction of the ceramic heater 1. As shown in FIG. 2, the heat generating resistor 4 is buried in the ceramic bodies 2 and 3. The edge of the heat generating resistor is formed so as to taper off toward the distal end. FIG.

Figure 3:
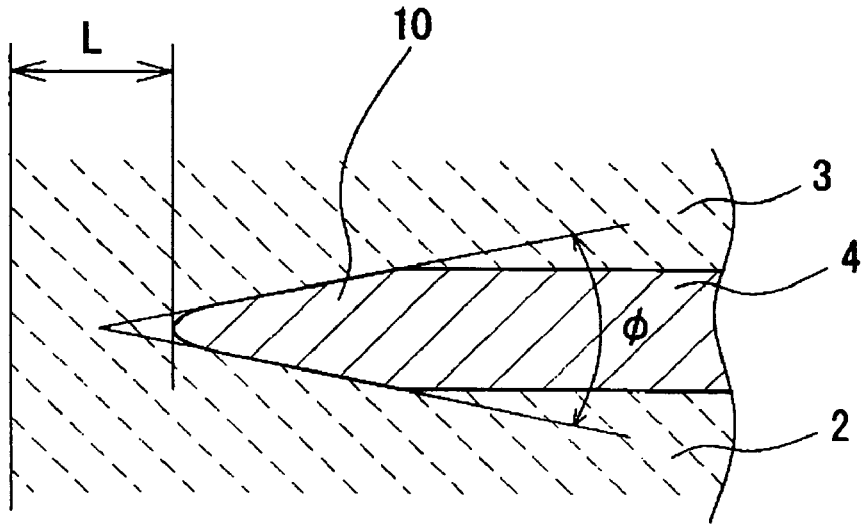
FIG. 3 is a partially enlarged sectional view of a portion near an edge of a heat generating resistor according to the first embodiment.
Figure 4:
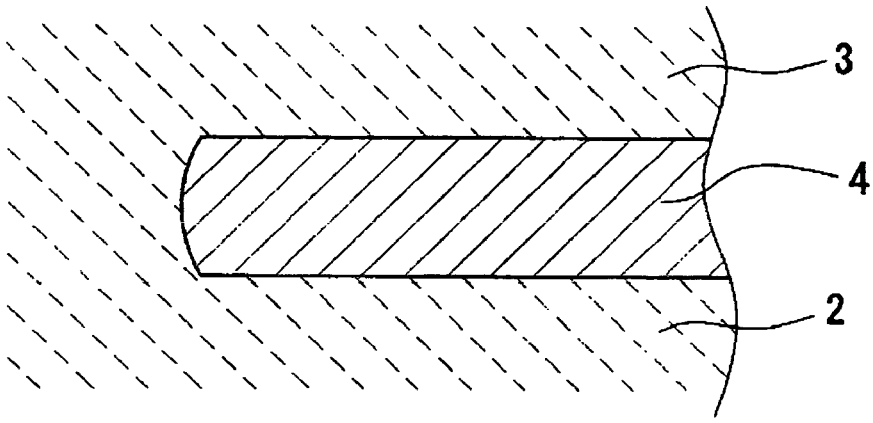
FIG. 4 is a partially enlarged sectional view of a portion near an edge of a heat generating resistor of the prior art.

3 is a partially enlarged sectional view of a portion near an edge 10 of the heat generating resistor 4. As shown in FIG. 3, the edge 10 of the heat generating resistor 4 is formed so as to taper off toward the distal end, and is controlled so that the angle ϕ of the edge of the heat generating resistor is 60° or less. In the ceramic heater of the prior art, in contrast, edge of the heat generating resistor 4 is substantially rectangular as shown in FIG. 4. The angle ϕ of the edge 10 of the heat generating resistor 4 refers to the angle between a tangential line that makes contact at a mid point of an upper tapered surface of the edge 10 of the heat generating resistor 4 and a tangential line that makes contact at a mid point of a lower tapered surface when viewed from a cross section perpendicular to the direction of extending the heat generating resistor.

In case the angle ϕ is larger than 60, thermal expansion of the ceramic bodies 2 and 3 cannot follow the thermal expansion of the heat generating resistor 4 when the ceramic heater 1 is repeatedly subjected to quick heating and quick cooling, thus causing concentrated stress in the edge 10 of the heat generating resistor that may lead to cracks and/or wire breakage. When the angle ϕ is made smaller than 60°, not only the amount of thermal expansion of the edge 10 of the heat generating resistor 4 becomes smaller but also the amount of heat generated by the edge 10 of the heat generating resistor becomes smaller. As a result, even when heat dissipation from the ceramics that surrounds the edge 10 of the heat generating resistor is insufficient, concentration of stress in the edge 10 of the heat generating resistor can be avoided. This makes it possible to prevent cracks and wire breakage from occurring when the ceramic heater is repeatedly subjected to quick heating and quick cooling, thus enabling it to obtain the ceramic heater having excellent durability. In order to avoid stress concentration in edge 10 of the heat generating resistor, it is preferable to decrease the angle ϕ of the edge 10 small. The angle ϕ is preferably 45° or less, and more preferably 30° or less. However, since the resistance becomes higher when the angle ϕ is made too small, the angle ϕ is preferably 5° or larger.

The angle ϕ of the edge of the heat generating resistor 4 may be controlled to 60° or less over the entire periphery of the heat generating resistor 4, or may be controlled to 60° or less only in a portion where the stress is concentrated. While the heat generating resistor 4 is formed in a meandering pattern as shown in FIG. 1B, stress tends to be concentrated in a bending portion 9. Therefore it is preferable to control the angle ϕ of the edge of the heat generating resistor to 60° or less in the bending portion 9 of the heat generating resistor. The bending portion 9 refers to the curved section that connects straight portions in the turnover of the wiring pattern of the heat generating resistor. In this portion, heat is dissipated more from the outside of the bend than from the inside of the bend, and therefore stress is concentrated in the edge 10 of the heat generating resistor more in the bending portion than in the straight portions. Accordingly, durability of the ceramic heater can be effectively improved by making the angle ϕ of the edge 10 in the bending portion 9 to 60° or less. In order to improve durability particularly effectively, it is preferable to make the angle ϕ of the edge 10 on the outside of the bending portion of the heat generating resistor to 60° or less.

The angle of the edge 10 of the heat generating resistor can be controlled as follows. The heat generating resistor 4 is formed by printing a paste material and firing it. When viscosity of the paste for forming the heat generating resistor 4 is decreased and TI value (thixotropy index) is also decreased, the paste that has been printed spreads before drying, thus becoming thinner near the edge. Viscosity of the paste for forming the heat generating resistor 4 is preferably controlled in a range from 5 to 200 Pa·s. When viscosity of the paste for forming the heat generating resistor 4 is lower than 5 Pa·s, the paste cannot be printed accurately. Viscosity of the paste for forming the heat generating resistor 4 higher than 200 Pa·s makes the paste that has been printed likely to dry before spreading. In order to satisfy both requirements of printing accuracy and controlling the thickness of the printed film, viscosity of the paste for forming the heat generating resistor 4 is preferably in a range from 5 to 200 Pa·s, more preferably from 5 to 150 Pa·s. Viscosity of the paste can be determined as follows. A proper amount of the paste is placed on a sample stage, which is maintained at a constant temperature of 25° C., of a type E viscosity meter manufactured by Tokyo Keiki. Then after keeping the sample rotating at 10 revolutions per second for 5 minutes, the viscosity is measured.

TI value (thixotropy index) is the ratio of the initial viscosity of the paste measured by the viscosity meter to the viscosity measured when rotating at 10 times faster to increase the shearing force. Higher value of TI means that viscosity of the paste sharply decreases when it is subjected to a shearing force and increases when the shearing force is removed. A paste having a high value of TI has a low viscosity so that it can be printed in a desired shape, but changes to have a high viscosity that forms the edge of the heat generating resistor in a shape near rectangle. In order to the angle ϕ of the edge 10 of the heat generating resistor to 60° or less, it is preferable to control the TI value of the paste to 4 or lower.

The angle of the edge 10 of the heat generating resistor 4 can be decreased by applying a pressure to the ceramic sheet and the heat generating resistor printed thereon in a direction perpendicular to the ceramic sheet. The angle of the edge 10 of the heat generating resistor can be determined from an SEM image of a cross section of the ceramic heater.

The distal end of the heat generating resistor preferably has curved shape having radius of curvature not larger than 0.1 mm in a cross section perpendicular to the direction of wiring the heat generating resistor. When the radius of curvature of the distal end is larger than 0.1 mm, the edge 10 of the heat generating resistor cannot have a sharp form and a larger amount of heat may be generated from the edge 10 of the heat generating resistor. When the radius of curvature of the distal end is controlled to 0.1 mm or less, heat generation becomes smaller at a position nearer to the distal end of the heat generating resistor thus enabling it to suppress stress concentration in edge 10 of the heat generating resistor. It is desired that the radius of curvature of the distal end of the heat generating resistor 4 is as small as possible, preferably 0.05 mm or less and more preferably 0.02 mm or less.

Mean thickness of the heat generating resistor 4 at the center in the direction of width thereof is preferably 100 μm or less. When mean thickness at the center in the direction of width is larger than 100 μm, there arises a large difference between the amount of heat generated from the end of the heat generating resistor 4 and the amount of heat generated from a mid portion of the heat generating resistor 4, which may cause the stress to be concentrated in the edge 10 of the heat generating resistor. The difference between the amount of heat generated from the edge 10 of the heat generating resistor 4 and the amount of heat generated from a mid portion of the heat generating resistor 4 can be made smaller by controlling the mean thickness of the heat generating resistor 4 at the center in the direction of width thereof to 100 μm or less, thus making it possible to prevent the stress from being concentrated in the edge 10 of the heat generating resistor. In order to prevent the stress from being concentrated in the edge 10 of the heat generating resistor, mean thickness of the heat generating resistor at the center in the direction of width thereof is preferably smaller. Mean thickness of the heat generating resistor at the center in the direction of width thereof is preferably 60 μm or less, and more preferably 30 μm or less. However, since the amount of heat generation becomes insufficient when mean thickness of the heat generating resistor 4 at the center in the direction of width thereof is too small, mean thickness of the heat generating resistor 4 at the center in the direction of width thereof is preferably not smaller than 5 μm.

The distance from the edge 10 of the heat generating resistor to the surface of the ceramic heater is preferably 50 μm or larger. In the case shown in FIG. 2, the distance in the direction perpendicular to the heat generating resistor 4 between edge 10 of the heat generating resistor and the surface of the ceramic heater is preferably 50 μm or larger. When the distance between the edge 10 of the heat generating resistor and the surface of the ceramic heater is less than 50 μm, the ceramic body cannot be properly heated due to heat dissipation from the surface of the ceramic heater. This results in a significant difference in thermal expansion coefficient between the heat generating resistor and the ceramic material that causes stress concentration in edge 10 of the heat generating resistor, thus leading to low durability of the ceramic heater. When the distance from the edge 10 of the heat generating resistor to the surface of the ceramic heater is controlled to 50 μm or larger, stress on the heat generating resistor can be mitigated. In order to avoid stress concentration in edge 10 of the heat generating resistor, it is advantageous that the distance from the edge 10 of the heat generating resistor to the surface of the ceramic heater is larger. Accordingly, the distance from the edge 10 of the heat generating resistor to the surface of the ceramic heater is preferably 100 μm or larger, and more preferably 200 μm or larger.

The thickness of the ceramic body 3 is preferably 50 μm or larger. When thickness of the ceramic body 3 is less than 50 μm, heat dissipation from the surface of the ceramic heater impedes temperature rise of the ceramic body, thus giving rise to a large difference in thermal expansion coefficient between the heat generating resistor and ceramic material. The difference in thermal expansion coefficient between the edge 10 of the heat generating resistor and the ceramic material can be made small by setting the thickness of the ceramic body 3 to 50 μm or more, thus making it possible to prevent the stress from being concentrated in the edge 10 of the heat generating resistor. This makes it possible to prevent cracks and wire breakage from occurring when the ceramic heater is repeatedly subjected to quick heating. In order to prevent the stress from being concentrated in the edge 10 of the heat generating resistor, it is preferable to make the thickness of the ceramic body larger. Thickness of the ceramic body is preferably 100 μm or larger, and more preferably 200 μm or larger.

Main component of the ceramic bodies 3 and 4 is preferably alumina or silicon nitride. The ceramic body made of such a material can be formed by firing at the same time with the heat generating resistor, and therefore residual stress can be made small. Since the ceramic body made of such a material also has high strength, it is made possible to prevent the stress from being concentrated in the edge 10 of the heat generating resistor. Thus durability of the ceramic heater can be improved.

When the ceramic bodies 3 and 4 are formed from ceramics containing alumina as the main component, it preferably contains 88 to 95% by weight of $Al_2O_3$, 2 to 7% by weight of $SiO_2$, 0.5 to 3% by weight of CaO, 0.5 to 3% by weight of MgO, and 1 to 3% by weight of $ZrO_2$. $Al_2O_3$ content less than the above leads to a higher content of glass component which causes significant migration when electric power is supplied, that is undesirable. When the $Al_2O_3$ content is higher than the above, the amount of glass component which diffuses into the metal layer of the heat generating resistor 4 decreases thus resulting in lower durability of the ceramic heater 1.

The heat generating resistor 4 preferably contains tungsten or a tungsten compound as the main component. Such a material has high heat resistance and enables it to fire the heat generating resistor and the ceramics at the same time. Therefore residual stress can be made small, and it is made possible to prevent the stress from being concentrated in the edge 10 of the heat generating resistor.

In the heat generating resistor 4, proportion of area occupied by a metal component in a cross section perpendicular to the direction of wiring thereof is preferably in a range from 30 to 95%. When the proportion of area occupied by a metal component is less than 30%, or conversely the proportion of area occupied by a metal component is more than 95%, difference in thermal expansion coefficient between the edge 10 of the heat generating resistor and the ceramic material becomes larger. The difference in thermal expansion coefficient between the edge 10 of the heat generating resistor and the ceramic material can be made smaller and it is made possible to prevent the stress from being concentrated in the edge 10 of the heat generating resistor, by setting the proportion of area occupied by a metal component in a cross section of the heat generating resistor 4 in a range from 30 to 95%. This makes it possible to prevent cracks and wire breakage from occurring when the ceramic heater is repeatedly subjected to quick heating, and improve the durability of the ceramic heater. In order to prevent the stress from being concentrated in the edge 10 of the heat generating resistor, it is more preferable to set the proportion of area occupied by a metal component in a cross section of the heat generating resistor 4 in a range from 40 to 70%. The proportion of area occupied by a metal component in a cross section of the heat generating resistor 4 can be determined from SEM image or an analytical method such as EPMA (electron probe micro analysis).

The electrode pad 7 of the ceramic heater 1 is preferably provided with a primary plating layer formed thereon after firing. The primary plating layer increases the fluidity of a brazing material thereby to increase the brazing strength when the lead member 8 is brazed onto the surface of the electrode pad 7. The primary plating layer preferably has thickness of 1 to 5 μm which provides sufficient bonding strength. The primary plating layer is preferably formed from Ni, Cr or a composite material that contains these metals as the main component. Among these, a plating material that contains Ni having high heat resistance as the main component is more preferably used. The primary plating layer is preferably formed by electroless plating in order to make the plating layer uniform in thickness. In case electroless plating is employed, uniform Ni plating can be formed when the base material is immersed in an active liquid that contains Pd in a pretreatment, since in this case the primary plating layer is formed on the on the electrode pad 7 around Pd atoms to replace them.

It is preferable to set the brazing temperature of connecting the lead member 8 with a brazing material to around 1000° C., since this decreases the residual stress that remains after the brazing process, thus achieving higher durability. In case humid operating environment is expected, it is preferable to use Au-based or Cu-based brazing materials which make migration less likely to occur. In view of heat resistance, brazing materials based on Au, Cu, Au—Cu, Au—Ni, Ag and Ag—Cu are preferable. Brazing materials based on Au—Cu, Au—Ni and Cu have high durability and are preferable, and a brazing material based on Au—Cu is particularly preferable. In the case of Au—Cu, high durability can be obtained when Au content is in a range from 25 to 95% by weight. In the case of Au—Ni, high durability can be obtained when Au content is in a range from 50 to 95% by weight. In the case of Ag—Cu, alloy of different composition can be prevented from being formed during brazing when Ag content is in a range from 71 to 73% since this composition results in eutectic composition. This decreases the residual stress that remains after the brazing process, and achieves higher durability of the ceramic heater.

It is preferable to form a secondary plating layer that is usually made of Ni on the surface of the brazing material, in order to improve the durability at high temperatures and protect the brazing material from corrosion. For the purpose of improving the durability, grain size of the crystal that constitutes the secondary plating layer is preferably 5 μm or smaller. When the grain size is larger than 5 μm, the secondary plating layer becomes weak and brittle and develops cracks when left in an environment at a high temperature. Smaller crystal grain size of the secondary plating layer makes it denser and enables it to prevent microscopic defects from occurring. Grain size of the crystal that constitutes the secondary plating layer is determined by averaging the sizes of grains included in a unit area on SEM. Grain size of the secondary plating layer can be controlled by changing the temperature of heat treatment applied after the secondary plating process.

The lead member 8 is preferably formed from an alloy of Ni or Fe—Ni that has high heat resistance. When the lead member 8 is formed from an alloy of Ni or Fe—Ni, mean crystal grain size thereof is preferably controlled to 400 μm or smaller. When the mean grain size is larger than 400 μm, the lead member 8 located near the brazing portion is fatigued due to vibration and thermal cycles during use, and cracks are likely to occur. In case the grain size of the lead member 8 is larger than the thickness of the lead member 8, stress is concentrated in grain boundaries near the interface between the brazing material and the lead member 8, thus making cracks likely to occur. Therefore, grain size of the lead member 8 is preferably smaller than the thickness of the lead member 8.

The mean crystal grain size of the lead member 8 can be made small by setting the brazing temperature as low as possible and carry out the process in a shorter period of time. However, in order to minimize the variability among samples, it is preferable to carry out the heat treatment during brazing at a somewhat higher temperature with a sufficient margin over the melting point of the brazing material.

The ceramic heater 1 may have such dimensions as 2 to 20 mm in outer diameter or width and 40 to 200 mm in length. The ceramic heater 1 used for heating an air-fuel ratio sensor of an automobile preferably has such dimensions as 2 to 4 mm in outer diameter or width and 50 to 65 mm in length. For automotive applications, the heat generating resistor 4 preferably has a heat generating section having length from 3 to 15 mm. When the heat generating section is shorter than 3 mm, although the temperature can be raised quickly by supplying electric power, durability of the ceramic heater 1 becomes lower. When the heat generating section is longer than 15 mm, it becomes slower to raise the temperature, and an attempt to increase the rate of heating results in greater power consumption by the ceramic heater 1. The length of the heat generating section refers to the length of a section between bends of cranked shape of the heat generating resistor 4 shown in FIG. 1. This length of the heat generating section may be selected according to the application.

Shape of the ceramic heater 1 is not limited to the cylindrical shape described in this embodiment. For example, the ceramic heater 1 may have a shape of tube or plate. Cylindrical or tube-shaped ceramic heater 1 may be manufactured as follows. The heat generating resistor 4, the lead-out section 5 and the through hole 6 are formed on the surface of the ceramic sheet 3, and the electrode pad 7 is formed on the back surface. Then the ceramic sheet 3 is wound around the ceramic core member 2 having cylindrical or tube shape with the surface having the heat generating resistor 4 formed thereon facing inside. At this time, the cylindrical ceramic heater 1 is made by using the ceramic core member 2 having cylindrical shape, and tube-shaped ceramic heater 1 is made by using the ceramic core member 2 having tube shape. The cylindrical or tube-shaped ceramic heater 1 is obtained by firing the assembly in a reducing atmosphere at a temperature from 1500 to 1600° C. After firing, the primary plating layer is formed on the electrode pad 7. Then the lead member 8 is connected by means of the brazing material and the secondary plating layer is formed on the brazing material.

Figure 5:
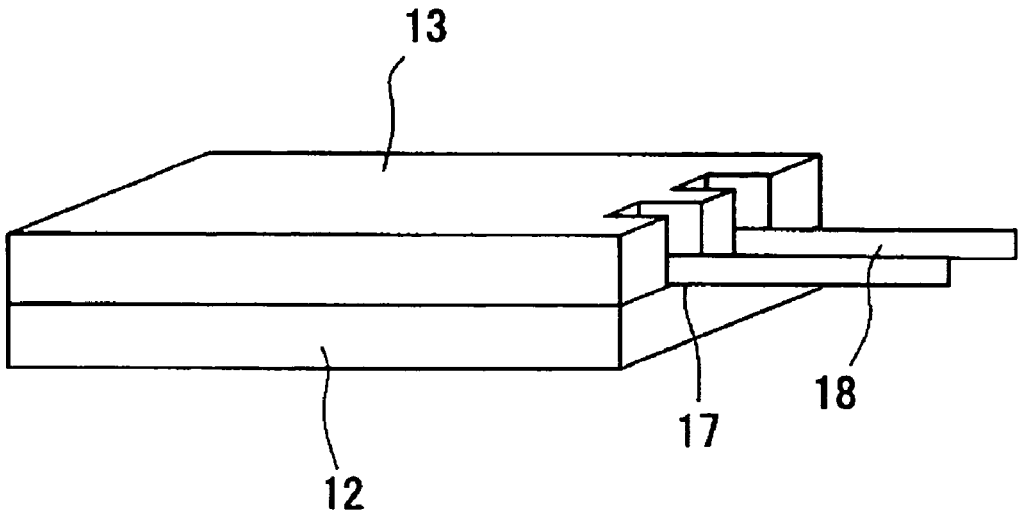
FIG. 5 is a perspective view showing an example of plate-shaped ceramic heater.

The method of manufacturing the ceramic heater of plate shape will now be described with reference to FIG. 5. The heat generating resistor 4, the lead-out section 5 and the electrode pad 7 are formed on the surface of the ceramic sheet 12. Another ceramic sheet 13 is placed in close contact on the surface whereon the heat generating resistor 4 is formed, with the assembly being fired in a reducing atmosphere at a temperature from 1500 to 1600° C. thereby making the ceramic heater of plate shape. After firing, the primary plating layer is formed on the electrode pad 7. Then the lead member 38 is connected by means of the brazing material and the secondary plating layer is formed on the brazing material.

Description of this embodiment is not limited to the case of alumina ceramics, but is applicable to ceramic heaters formed from any ceramics such as silicon nitride, aluminum nitride and silicon carbide.

Figure 6:
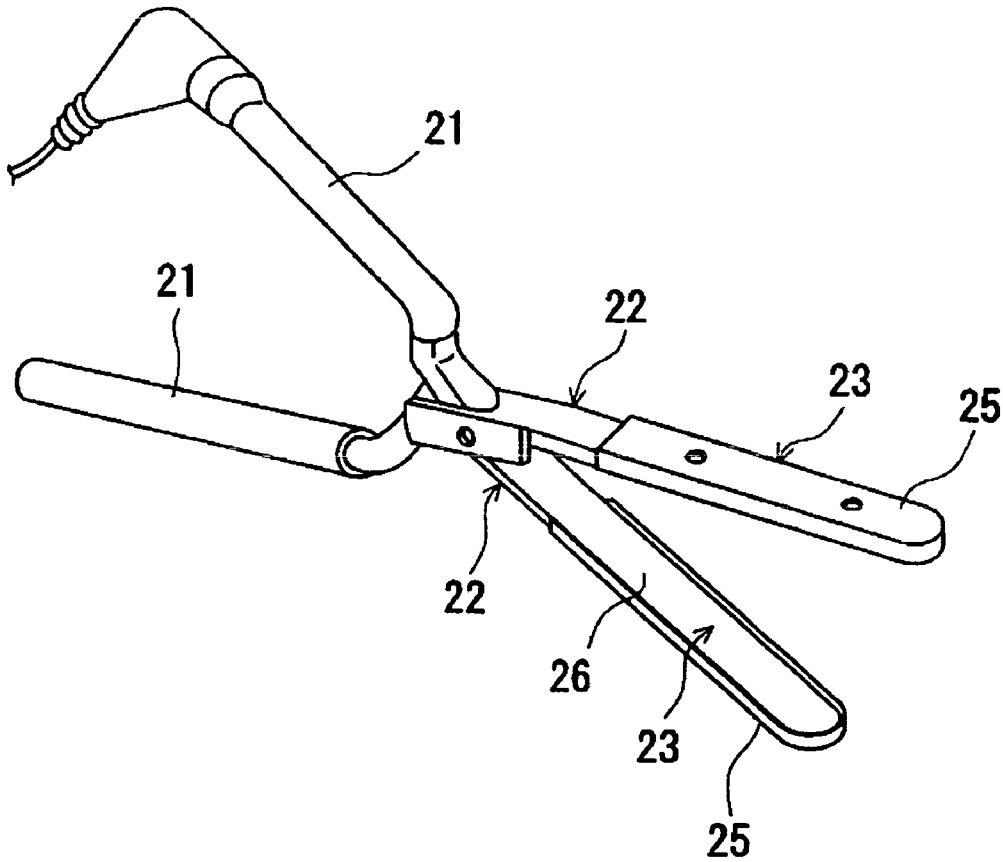
FIG. 6 is a perspective view showing an example of hair dressing iron.

FIG. 6 is a perspective view showing an example of a heating iron that employs the ceramic heater of this embodiment. The heating iron 6 is specifically a hair dressing iron. The hair dressing iron is used to dress hair by applying heat and pressure thereto with the hair held between arms 22 and gripping handles 21. The arms 22 have ceramic heaters 26 incorporated therein, with metal plates 23 made of stainless steel or the like provided on the portions that make contact with the hair. The arms 22 also have covers 25 made of heat resistant plastics provided on the outside thereof in order to prevent burning of human body. While the hair dressing iron has been shown as an example of the heating iron, the ceramic heater of this embodiment can be applied to any heating irons such as soldering iron, hot iron or clothes pressing iron.

Second Embodiment

Figure 7A:
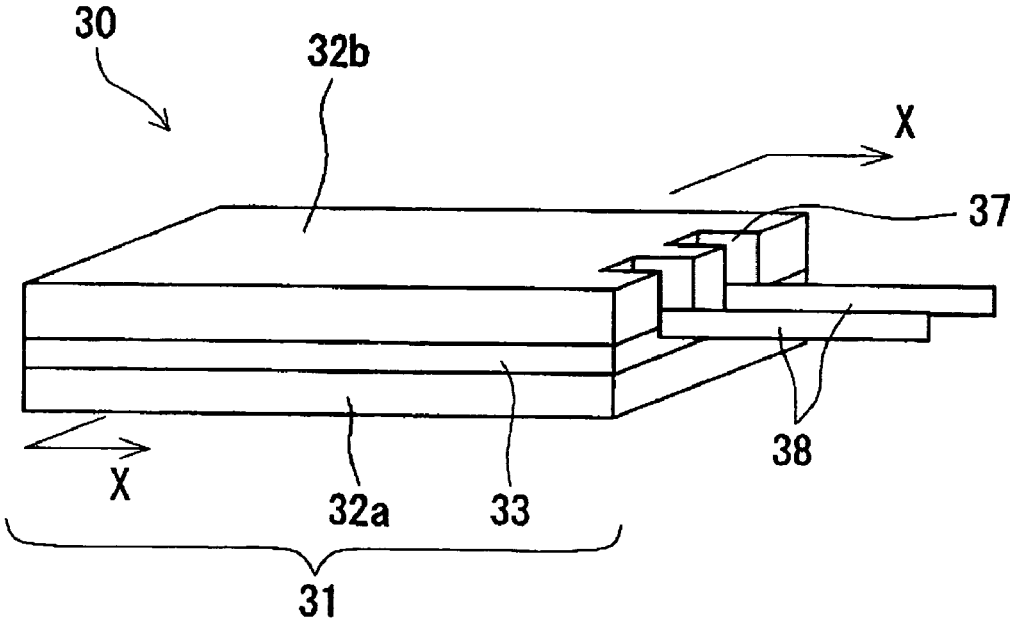
FIG. 7A is a perspective view of the ceramic heater according to the first embodiment of the present invention.
Figure 7B:
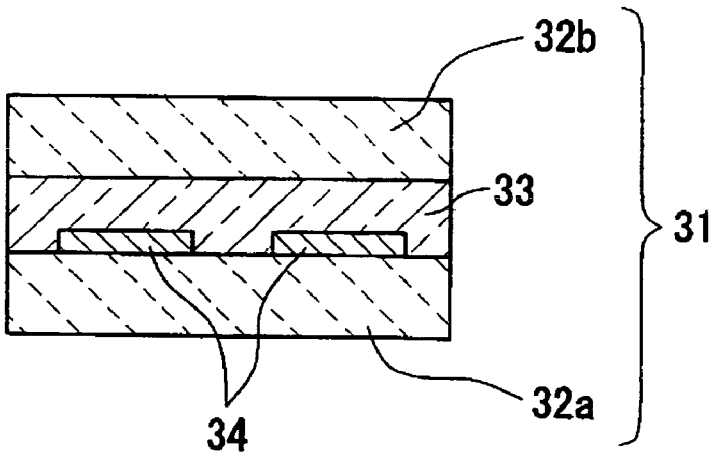
FIG. 7B is a sectional view taken along lines X-X of the ceramic heater shown in FIG. 7A.

In this embodiment, a ceramic heater having a sealing member formed between two ceramic bodies for bonding will be described. With other respect, this embodiment is the same as the first embodiment. FIG. 7A is a perspective view of the ceramic heater according to this embodiment, and FIG. 7B is a sectional view taken along lines X-X thereof.

Figure 8:
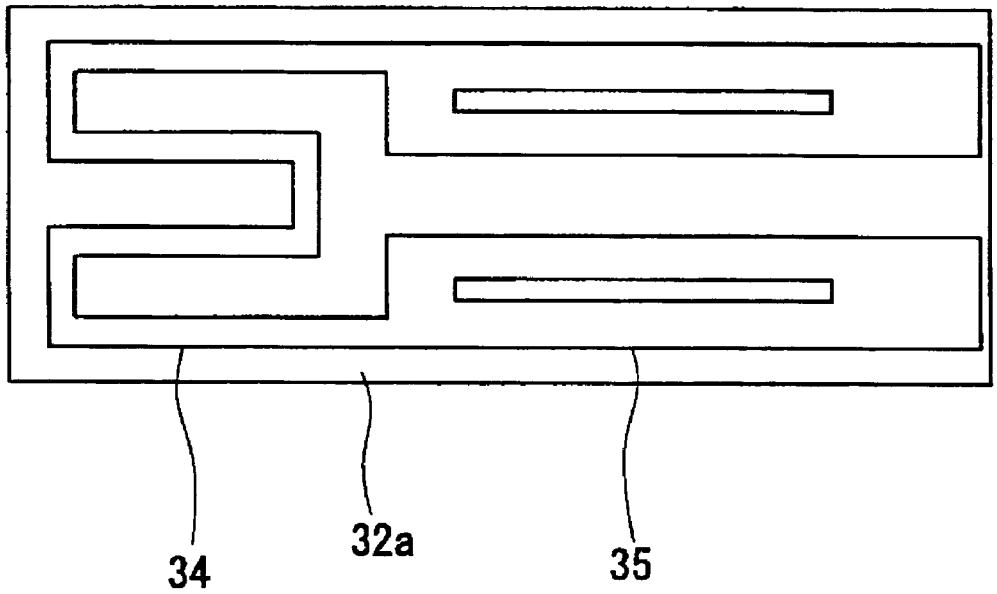
FIG. 8 is a plan view showing the configuration of the heat generating resistor of the ceramic heater shown in FIG. 7A.

The ceramic heater 30 is constituted essentially from a ceramic body 31 and a heat generating resistor 34 that is incorporated in the ceramic body 31. The ceramic body 31 is constituted from two kinds of inorganic materials: two ceramic sheets 32*a*, 32*b* and a sealing material 33 that joins the two sheets. As shown in FIG. 8, the heat generating resistor 34 and the lead-out section 35 are formed on the surface of the ceramic sheet 32*a*. The sealing material 33 is applied to the ceramic sheet 32*a* whereon the heat generating resistor 34 has been formed, and the ceramic sheet 32*b* is joined thereon. A notch 37 is formed in the ceramic sheet 32*b*, so that a part of the lead-out section 35 is exposed through the notch 37. The lead member 38 is connected to the exposed portion of the lead-out section 35 by means of a brazing material.

With the ceramic heater 30, the heat generating resistor 34 and the lead-out section 35 are formed by applying a paste that contains a metal of high melting point and glass onto the surface of the ceramic sheet 32*a* and applying baking treatment thereto. Then a glass paste that makes the sealing member 33 is applied and the ceramic sheet 32*b* is placed thereon, with the assembly being fired so as to turn it into a monolithic body. When the heat generating resistor 34 and the lead-out section 35 are formed onto the surface of the ceramic sheet 32*a* and fired, the value of resistance can be adjusted. That is, the heat generating resistor 34 can be trimmed so that resistance thereof falls within a predetermined range, after measuring the resistance of the heat generating resistor 34 and the lead-out section 35.

In the case of the first embodiment where the heat generating resistor is buried in the ceramic body and both members are then fired to integrate, it is difficult to adjust the resistance. Resistance of the heat generating resistor may be adjusted by trimming or other process when the heat generating resistor is simply formed on the surface of the ceramic body, although the heat generating resistor exposed on the surface has low durability.

In this embodiment, since the ceramic body 31 is made of two inorganic materials and the heat generating resistor 34 is covered by the sealing material 33 after being trimmed, high durability is achieved. Also because the ceramic sheet 33*b* can be joined onto the sealing material 33 even after the heat generating resistor 34 has been fired, cracks can be prevented from occurring in the sealing material 33.

The sealing material 33 is preferably formed from a material that contains glass. Glass used in the sealing material 33 is preferably such that the difference between the thermal expansion coefficient of the glass and the thermal expansion coefficient of the ceramic sheets 23*a*, 32*b* at a temperature below the glass transition point is within $1\times10^{-5}/°$ C. When the difference in thermal expansion coefficient is larger than this value, the sealing material 33 is subject to significant stress during use, and is likely to be cracked. The difference in the thermal expansion coefficient is preferably within $0.5\times10^{-5}/°$ C., more preferably within $0.2\times10^{-5}/°$ C. and ideally within $0.1\times10^{-5}/°$ C.

Figure 9:
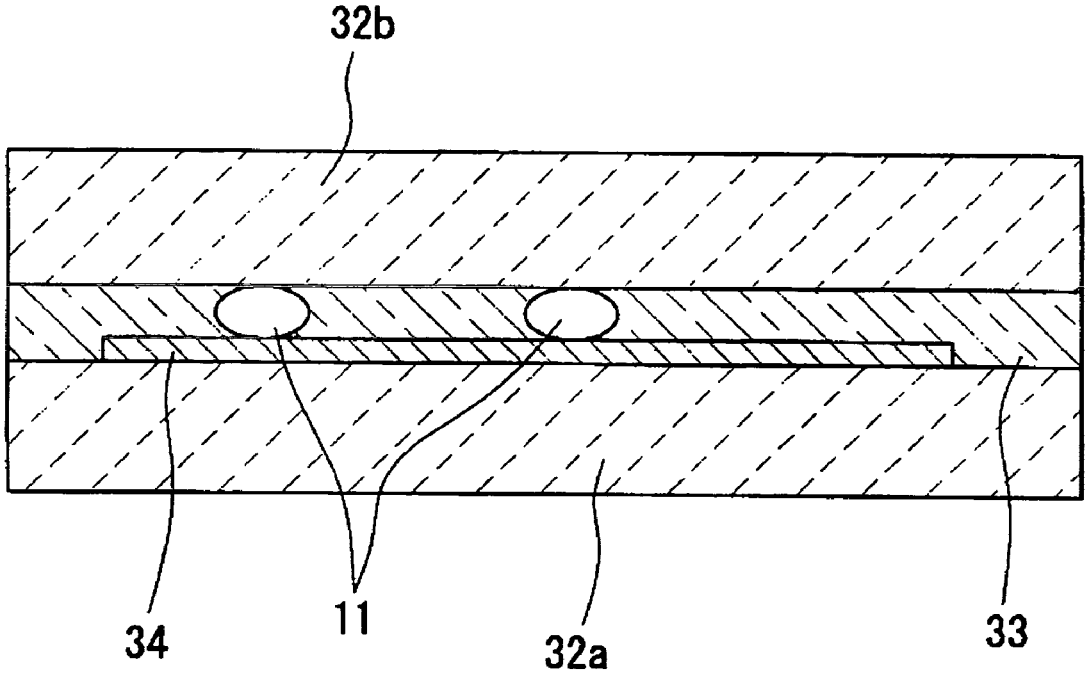
FIG. 9 is a sectional view schematically showing a cross section of the ceramic heater shown in FIG. 7A.

Void ratio in the sealing material 33 is preferably controlled to 40% or lower. When the void ratio is higher than 40%, the sealing material 33 is subject to cracks due to thermal cycle during use, thus resulting in lower durability of the ceramic heater 30. When the sealing material 33 and the ceramic body 32*b* that is placed thereon deviate from the desirable flatness, voids may be formed when bonding the two members. Void ratio in the sealing material 33 is more preferably controlled to 30% or lower. Void ratio in the sealing material 33 can be determined by polishing a cross sectional surface of the ceramic heater 30 and calculating the ratio of area $S_b$ of voids 11 to area $S_g$ of the sealing material 33 exposed in the cross section, as shown in FIG. 9. The areas $S_g$ and $S_b$ may also be simply measured by analyzing the image taken by an electron microscope (SEM).

Mean thickness of the sealing material 33 is preferably 1 mm or less. When thickness of the sealing material 33 is larger than 1 mm, cracks occur in the sealing material 33 as the ceramic heater 30 is subjected to quick heating. When thickness of the sealing material 33 is less than 5 μm, the sealing material cannot sufficiently fill in the steps formed around the heat generating resistor 34, thus allowing many voids 11 to be formed resulting in lower durability of the ceramic heater 30.

When forming the sealing material 33, voids 11 can be suppressed from being formed in the sealing material 33 by once melting the material (glass, etc.) of the sealing material applied to the ceramic sheet 32*a* and remove air therefrom before placing the ceramic 32*b* thereon.

The ceramic sheets 32*a*, 32*b* are preferably formed from oxide ceramics such as alumina or mullite, although non-oxide ceramics such as silicon nitride, aluminum nitride or silicon carbide may also be used. When non-oxide ceramics is used, affinity between the heat generating resistor 34, the lead-out section 35 and the sealing member 33 is improved and durability of the ceramic heater 30 is improved by carrying out heat treatment in oxidizing atmosphere and forming an oxide layer on the surface of the ceramic sheet 32*a*.

Flatness of the surfaces of the ceramic sheets 32*a*, 32*b* is preferably within 200 μm, more preferably within 100 μm and ideally within 30 μm. When flatness of the surfaces of the ceramic sheets 32*a*, 32*b* exceeds 200 μm, voids 11 are likely to be formed in the sealing member 33 as shown in FIG. 9, thus resulting in lower durability of the ceramic heater 30.

In the case of oxide ceramics, it is preferable to use the surface as sintered. This is because the glass component contained in the ceramics segregates and moves toward the surface when fired, thereby making it easier to form the heat generating resistor 34 and the lead-out section 35.

The heat generating resistor 34 may be formed from such element as W, Mo or Re, an alloy thereof, or carbide, silicate or the like of metal such as TiN or WC. Use of such a metal having high melting point improves durability since sintering of the metal does not proceed during use.

Figure 10:
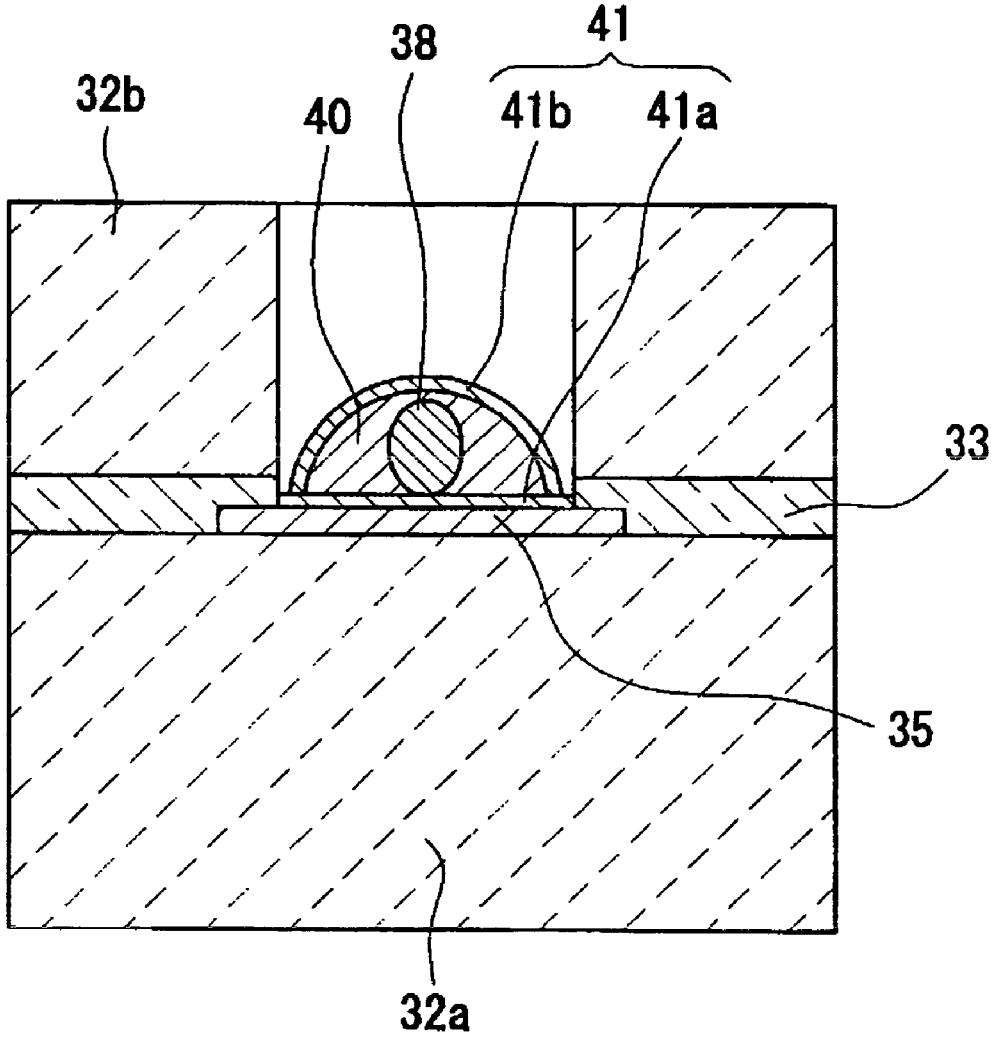
FIG. 10 is a partially enlarged sectional view of a portion near a junction of lead member of the ceramic heater shown in FIG. 7A.

FIG. 10 is an enlarged view showing an example of the brazed portion of the lead member 9. With such a configuration as the periphery of the electrode pad 35 is interposed between the ceramic sheets 32*a*, 32*b* as shown in FIG. 10, bonding strength of the electrode pad 35 can be increased. A primary plating layer 41*a* is formed on the surface of the electrode pad 35. This improves the fluidity of the brazing material 40 during brazing operation of the lead member 38. It is preferable to set the brazing temperature of connecting the lead member 38 with a brazing material 40 to around 1000° C., since this decreases the residual stress that remains after the brazing process. It is preferable to form the secondary plating layer 41*b* on the surface of the brazing material 40, similarly to the first embodiment.

Third Embodiment

Figure 11:
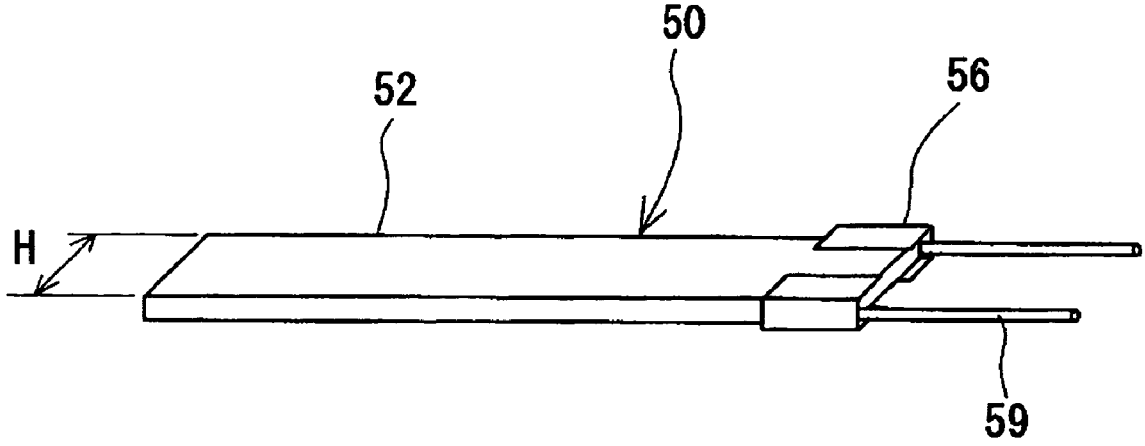
FIG. 11 is a perspective view of a ceramic heater according to a third embodiment of the present invention.
Figure 12:
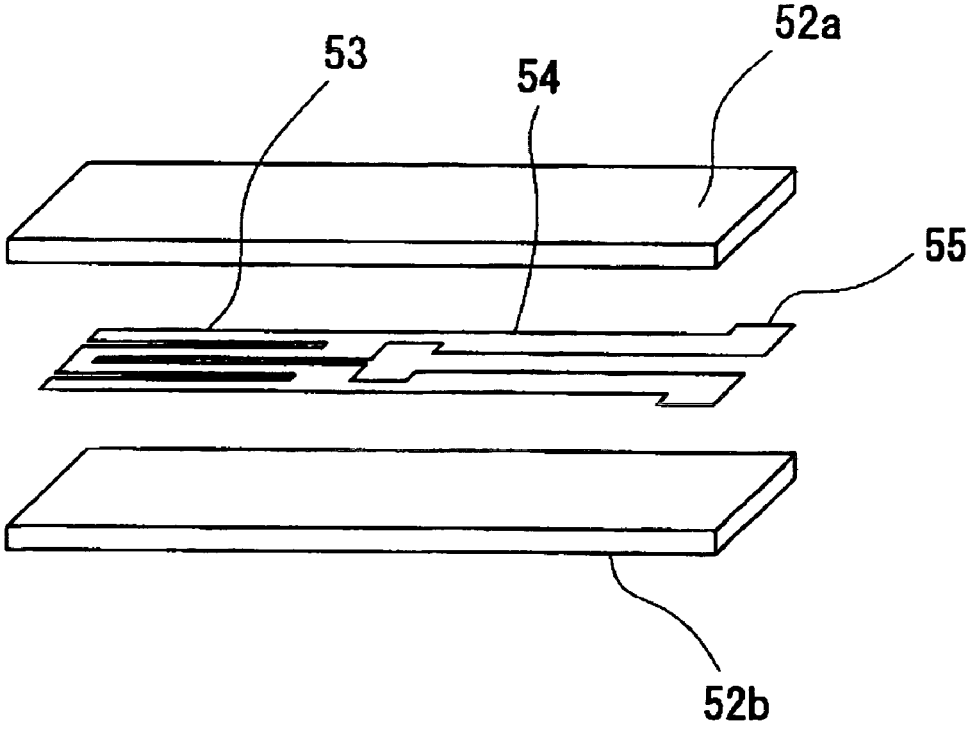
FIG. 12 is an exploded view showing the structure of the ceramic heater shown in FIG. 11.
Figure 13A:
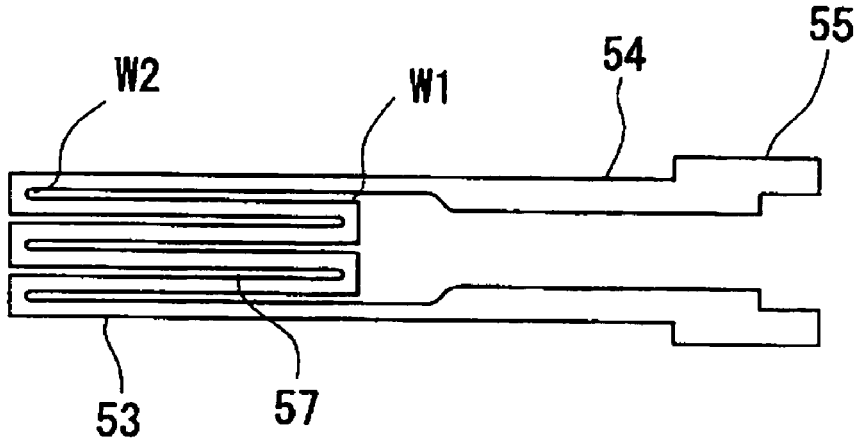
FIG. 13A is a plan view showing a heat generating resistor.
Figure 13B:
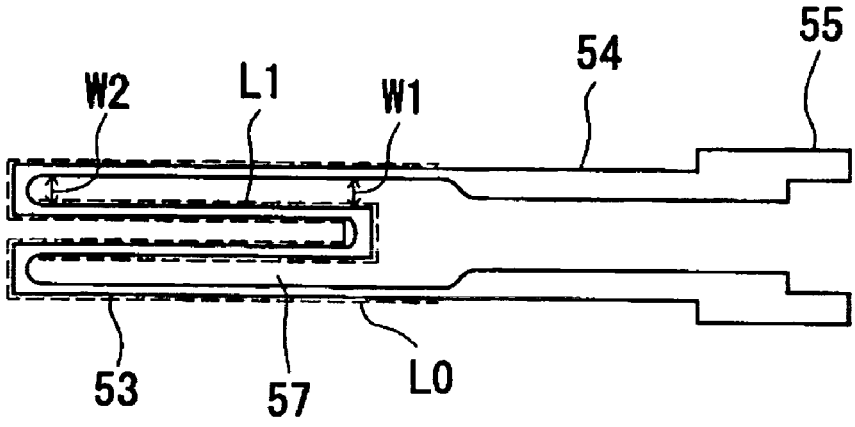
FIG. 13B is a plan view showing a heat generating resistor.

In this embodiment, a ceramic heater constituted from silicon nitride ceramics as the base material that is used at high temperatures and under high voltages such as ignition heater will be described. FIG. 11 is a perspective view of the ceramic heater according to this embodiment, and FIG. 12 is an exploded view thereof. A heat generating resistor 53, a lead member 54 and a lead-out section 55 are buried in the ceramic body 52. The lead-out section 55 is connected to an electrode fixture 56 via a brazing material which is not shown. A lead member 59 is connected to the electrode fixture 56.

The ceramic heater shown in FIG. 11 and FIG. 12 can be manufactured by printing the heat generating resistor 53, the lead member 54 and the electrode lead-out section 55 on the surface of the ceramic sheet 52*a*, placing another ceramic sheet 52*b*, firing the assembly by a hot press at a temperature from 1650 to 1780° C. and attaching the electrode fixture 56.

Figure 15:
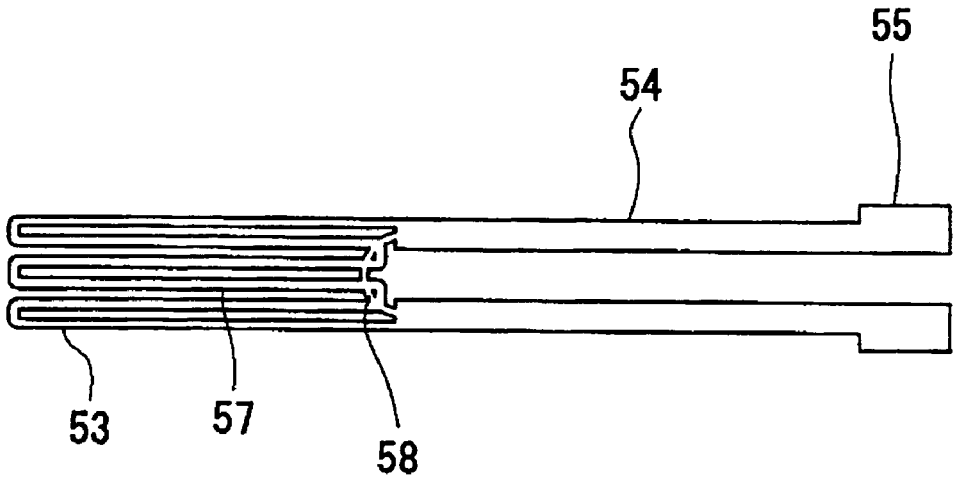
FIG. 15 is a plan view showing an example of the heat generating resistor that underwent insulation breakdown.

The ceramic heater is prone to insulation breakdown that tends to take place in portions where potential difference is high and the temperature becomes 600° C. or higher. As a result, possibility of insulation breakdown increases as size reduction of the ceramic heater proceeds and the heat generating resistor 53 is disposed with smaller distance therebetween. When a ceramic heater constituted from silicon nitride ceramics as the base material is used at a high temperature under a high voltage, migration of such elements as ytterbium (Yb), yttrium (Y) or erbium (Er) added as sintering assisting agent occurs due to the electric field as the heating operation is repeated, resulting in lower density of the sintering assisting agent in the interposed region 57 between adjacent sections of the heat generating resistor 53 thus leading to insulation breakdown. The insulation breakdown 58 initiates in the interposed region 57 between adjacent sections of the heat generating resistor 53 where the potential difference is high and develops involving the lead member 54 as shown in FIG. 15. In a portion where insulation breakdown occurred, melting of the heat generating resistor 53 causes short circuiting.

Insulation breakdown may be prevented from occurring by using a voltage controller so that a high voltage will not be applied to the ceramic heater, but it adds to the cost. There is a demand for a ceramic heater that can be used over a wide range with high durability even when high voltages are applied due to voltage fluctuation.

Figure 14A:
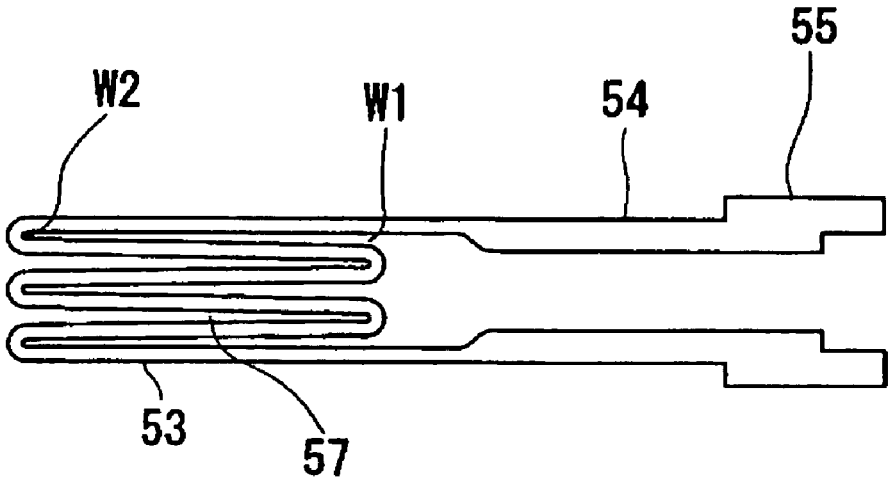
FIG. 14A is a plan view showing the heat generating resistor according to the third embodiment of the present invention.
Figure 14B:
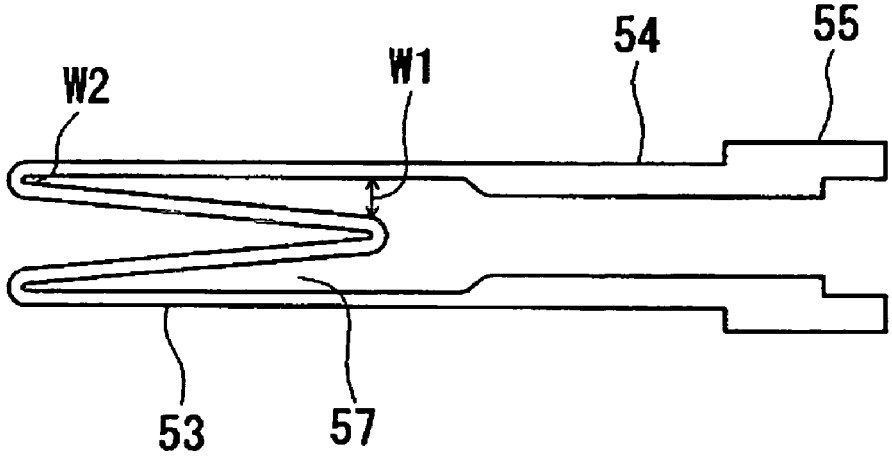
FIG. 14B is a plan view showing another example of the heat generating resistor according to the third embodiment of the present invention.

A ceramic heater 50 is formed in such a constitution as the linear heat generating resistor 53 is wrapped around repetitively so that the length of wiring the heat generating resistor 53 becomes longer, as shown in FIG. 14A. In case the heat generating resistor 53 is wrapped around repetitively, the narrow interposed region 57 is formed between two adjacent parallel sections of the heat generating resistor 53. Potential difference generated in the interposed region 57 is not constant, but changes along the heat generating resistor. That is, potential difference is small in the interposed region 57 located near turnover of the heat generating resistor 53, and is large in the interposed region 57 located away from turnover of the heat generating resistor 53. In other words, potential difference in the interposed region 57 between the adjacent sections of the heat generating resistor 53 is small on the side of closed end and is large on the side of open end. This embodiment is characterized in that distance $W_1$ between adjacent sections of the heat generating resistor on the side of higher potential difference is made large and distance $W_2$ between adjacent sections of the heat generating resistor on the side of lower potential difference is made small in the reciprocal pattern of the heat generating resistor 53, as shown in FIGS. 14A and 14B.

When the distance $W_1$ between adjacent sections of the heat generating resistor on the side of higher potential difference across the interposed region 57 is made large and electric field intensity is controlled to within 120 V/mm, migration of the sintering assisting agent due to ion movement is suppressed and insulation breakdown is prevented from occurring. The electric field intensity is given by the formula described below, where $V_0$ is the voltage that is applied to maintain the ceramic heater at 1400° C. $L_1$ is the distance along the heat generating resistor 5 between two points that are located apart from each other in an end section of large potential difference of the heat generating resistor 53, namely the length of a U-shaped section from start to end of the bend. $L_0$ is the total length of the heat generating resistor 53. $V_1$ is the potential difference across the interposed region 57 on the side of larger potential difference. $W_1$ is the distance between adjacent sections of the heat generating resistor.

$$V_1 = L_1/L_0 \times V_0$$

$$\text{Electric field} = V_1/W_1$$

Electric field on the side of larger potential difference is preferably 80 V/mm or less. It is also preferable to change the distance W between the adjacent sections of the heat generating resistor 53, that is buried in a meandering shape, continuously from the side of larger potential difference toward the side of smaller potential difference. As width W decreases continuously from side of larger potential difference toward the side of smaller potential difference, distance of insulation also decreases continuously, and therefore the relationship between the potential difference and the distance of insulation is maintained constant. As a result, migration of the sintering assisting agent due to ion movement is suppressed and the rupture mode of the ceramic heater 50 changes from insulation breakdown to damage on the heat generating resistor.

A method of manufacturing the ceramic heater according to this embodiment will now be described.

First, the ceramic body 52*a* is made. The ceramic body 52*a* is preferably formed from silicon nitride ceramics that has high strength, high toughness, high insulation property and high heat resistance. Stock material powder is prepared by adding 0.5 to 3% by weight of $Al_2O_3$, 1.5 to 5% by weight of $SiO_2$ and 3 to 12% by weight of oxide of rare earth element such as $Y_2O_3$, $Yb_2O_3$ and $Er_2O_3$, as the sintering assisting agent to silicon nitride used as the main component. This powder is molded by pressing to make a ceramic compact 52*a*. A paste prepared by mixing tungsten, molybdenum, rhenium or the like or carbide or nitride thereof and organic solvent is printed by screen printing or other method onto the ceramic sheet 52*a*, thereby to form the heat generating resistor 53, the lead member 54 and the electrode lead-out section 55. After placing the ceramic compact 52*b* thereon, the assembly is fired by a hot press at a temperature from 1650 to 1780° C. Thus the ceramic heater of this embodiment is made. The content of $SiO_2$ described above is the total content of $SiO_2$ formed from impurity oxygen contained in the ceramic body 52 and $SiO_2$ that is intentionally added.

Durability of the heat generating resistor 53 can be improved by dispersing $MoSi_2$ or $WSi_2$ in the ceramic body 52 so as to make the thermal expansion coefficient of the ceramic body proximate to that of the heat generating resistor 53.

The heat generating resistor 53 may be formed from a material that contains carbide, nitride or silicate of W, Mo or Ti. Among these materials, WC is particularly suited as the material to form the heat generating resistor 3 in view of thermal expansion, heat resistance and specific resistance. The heat generating resistor 53 is preferably formed from a material that contains WC that is an electrically conductive inorganic material as the main component and 4% by weight or more BN. The electrically conductive material that makes the heat generating resistor 53 has higher thermal expansion coefficient than the silicon nitride and is therefore normally subjected to tensile stress in the silicon nitride ceramics. BN, in contrast, has lower thermal expansion coefficient than the silicon nitride and has low reactivity with the electrically conductive component of the heat generating resistor 53, so as to be advantageously used to mitigate the stress generated due to the difference in thermal expansion coefficient during heating and cooling of the ceramic heater 1. Since BN content higher than 20% by weight makes the resistance unstable, BN content is restricted to within 20% by weight. More preferably, BN content is controlled within a range from 4 to 12% by weight. 10 to 40% by weight of silicon nitride may also be added instead of BN to the heat generating resistor 3. Thermal expansion coefficient of the heat generating resistor 3 can be made proximate to the thermal expansion coefficient of the silicon nitride of the base material by increasing the quantity of silicon nitride that is added.

Fourth Embodiment

In this embodiment, a ceramic heater constituted from silicon nitride ceramics as the base material used at high temperatures and under high voltages such as ignition heater will be described similarly to the third embodiment. In this embodiment, too, the ceramic body 52 that contains silicon nitride ceramics as the main component has the heat generating resistor 53 and the lead member 54 that supplies electric power to the heat generating resistor 53 which are buried therein. A high voltage of 100 V or higher is applied to the device. This embodiment is characterized in that distance Y between the heat generating resistor 53 and the lead section 54 is set to 1 mm or larger in the ceramic heater. The embodiment is similar to the third embodiment with other respects.

Figure 16:
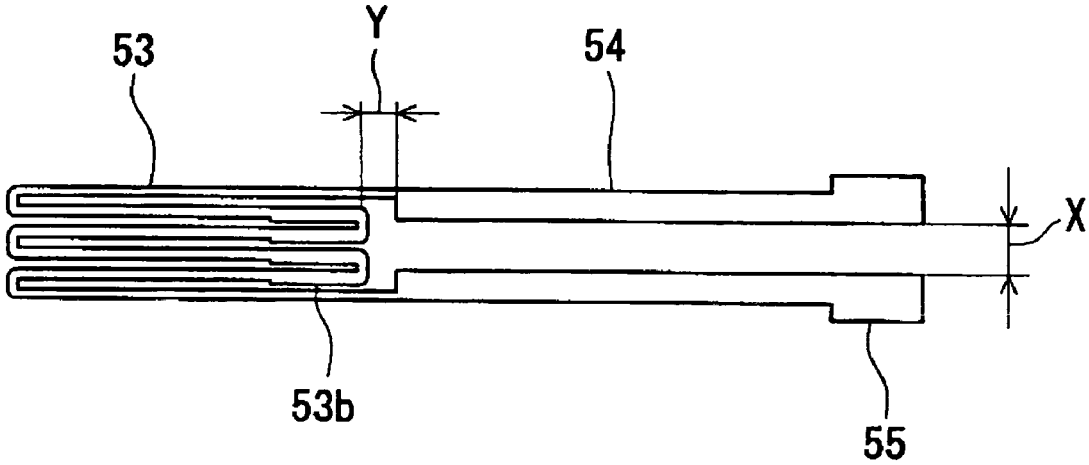
FIG. 16 is a plan view showing a heat generating resistor of a ceramic heater according to a fourth embodiment of the present invention.

As shown in FIG. 16, the heat generating resistor 53 has a plurality of turnovers. The lead section 54 refers to the portion where the conductor is wider than the heat generating resistor 53. Distance Y between the heat generating resistor 53 and the lead section 54 is the minimum distance between both ends. The end of the heat generating resistor 53 refers to the end of turnover as shown in FIG. 16. End of the lead section 54 means the portion where the conductor begins to become wider than the heat generating resistor 53.

When distance Y between the heat generating resistor 53 and the lead section 54 is set to less than 1 mm, insulation breakdown tends to occur in a relatively short period of time due to repeated heating and cooling, when temperature of the ceramic heater 1 becomes higher than 1100° C. during use. Insulation breakdown is likely to occur in a portion of high potential difference and high temperature. As shown in FIG. 15, the insulation breakdown 58 normally initiates in the lead section 54 located near the heat generating resistor 53 and develops involving the end of the heat generating resistor 53. Since the section from the electrode fixture 56 to the distal end of the lead section 54 has low resistance, there is a large potential difference between the end of the lead section 54 and the end of the heat generating resistor 53. This section also reaches a relatively higher temperature because of the position near the heat generating resistor 53 that generates heat. As a result, it is supposed that insulation breakdown takes place in the section between the end of the lead section 54 and the end of the heat generating resistor 53.

When distance Y between the heat generating resistor 53 and the lead section 54 is less than 1 mm, the rupture mode of the ceramic heater 50 changes from insulation breakdown to damage on the heat generating resistor 53. High durability of the heat generating resistor 53 is achieved since it is hardly affected by the potential difference. Insulation distance between the heat generating resistor 53 and the lead section 54 can be maintained by setting the distance Y between the heat generating resistor 53 and the lead section 54 to 1 mm or larger as shown in FIG. 16. When the maximum temperature of the heat generating resistor is set to 1100° C., insulation breakdown 58 becomes less likely to occur since the temperature difference between the lead section side end and the end of the lead section in the turnover of the heat generating resistor 53 is decreased 80° C. or more.

In case width H of the ceramic heater 50 is 6 mm or smaller (refer to FIG. 11) and distance X between adjacent wires in the lead section 54 is in a range from 1 to 4 mm (refer to FIG. 16), it is preferable that distance X between adjacent wires in the lead section 4 and distance Y between the heat generating resistor 3 and the lead section 4 satisfy the following relationship.

$$Y \geqq 3X^{-1}$$

When the heat generating resistor 53 and the lead section 54 are disposed so as to satisfy this relation, durability against insulation breakdown can be improved. While the possibility of insulation breakdown when a high voltage is applied increases as the distance X between adjacent wires in the lead section 54 becomes smaller, high durability can be maintained by increasing the distance Y between the heat generating resistor 53 and the lead section 54.

As described above, satisfactory durability can be achieved by setting the distance Y between the heat generating resistor 53 and the lead section 54 to 1 mm or larger. However, insulation breakdown may not be sufficiently suppressed when the distance X between adjacent wires in the lead section 54 becomes not larger than 4 mm due to dimensional restriction of the ceramic heater 50 or the like, or when width H becomes larger than 6 mm and the distance X between adjacent wires in the lead section 4 exceeds 4 mm. When the heat generating resistor 3 and the lead section 4 are disposed so as that the distance X between adjacent wires in the lead section 54 and the distance Y between the heat generating resistor 53 and the lead section 54 satisfy the relation described above, durability of a level similar to that of a ceramic heater having width H larger than 6 mm and the distance X between adjacent wires in the lead section 54 larger than 4 mm can be achieved. This is because temperature at the end of the lead section 54 can be decreased by making the distance Y between the heat generating resistor 53 and the lead section 54 larger.

In the ceramic heater of this embodiment, it is preferable to form a second heat generating section 53*b* having cross sectional area larger than the other portion in a portion of the turnover of the heat generating resistor 53 on the side of the lead section 54. Cross sectional area of the second heat generating section 53*b* in the heat generating resistor 53 is preferably 1.5 times that of the other portion of the heat generating resistor 53 or more. By providing the second heat generating section 53*b*, it is made possible to control the temperature difference between the lead section side end and the end of the lead section in the turnover of the heat generating resistor to not larger than 100° C. when the maximum temperature of the heat generating resistor is set to 1100° C. As a result, insulation breakdown can be suppressed from occurring and durability can be improved further. Upper limit of the cross sectional area of the second heat generating section 53*b* is determined by the width H of the ceramic heater 50. While the cross sectional area of the second heat generating section 53*b* can be increased by increasing the width of the heat generating resistor, distance between the lines of the second heat generating section 53*b* is preferably maintained to 0.2 mm or larger. Length of the second heat generating section 53*b* is advantageously controlled to within a range from 10 to 25% of the total length of the heat generating resistor. When the proportion is lower than 10%, temperature distribution becomes not significantly different from that of a case where the second heat generating section is not provided. When the proportion exceeds 25%, ignition performance of the ceramic heater 50 is affected.

Fifth Embodiment

Figure 17:
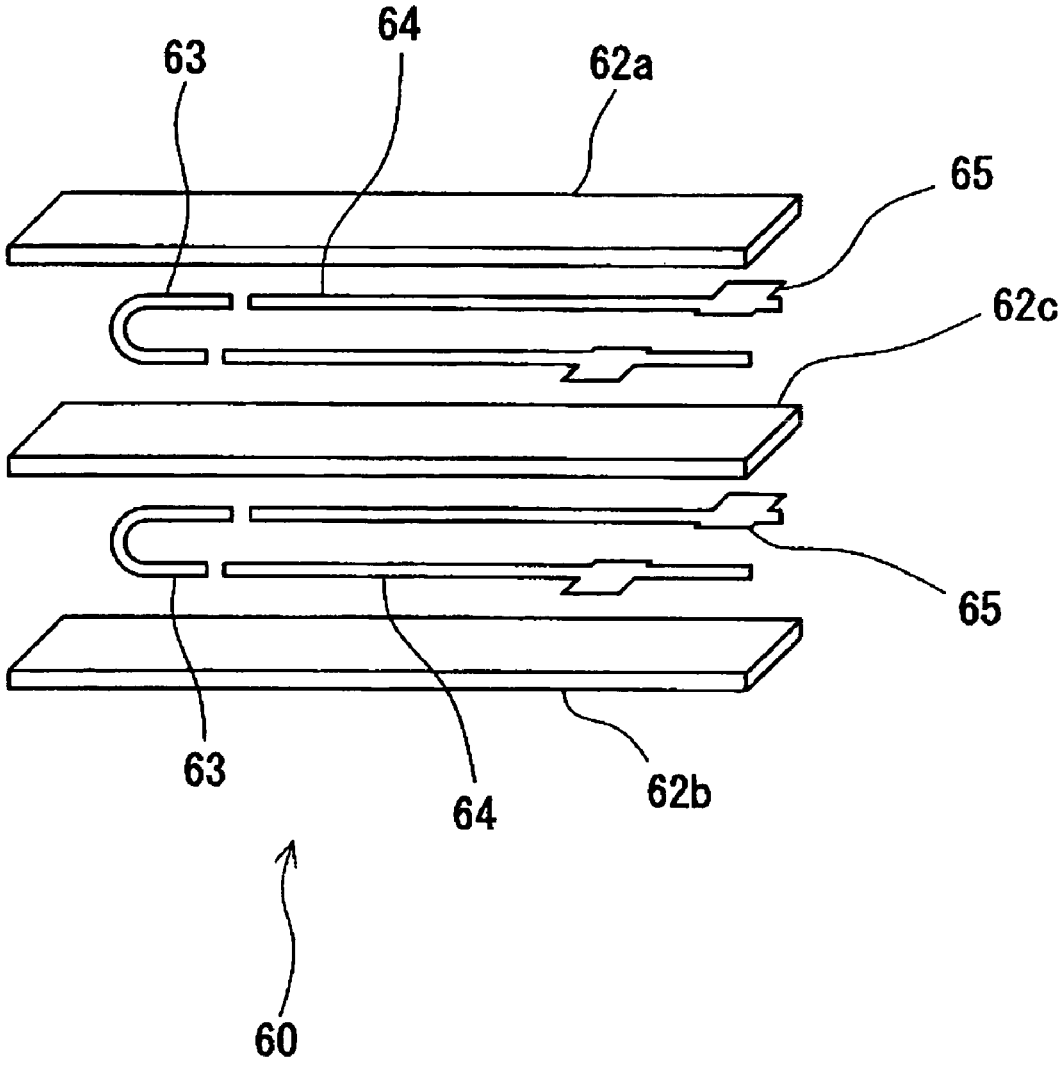
FIG. 17 is an exploded view showing a method for manufacturing the ceramic heater according to the fourth embodiment of the present invention.

FIG. 17 is an exploded perspective view of a ceramic heater according to this embodiment. A heat generating resistor 63 and an electrode lead-out section 65 are printed on the surface of ceramic compacts 62*a*, 62*b*, and lead pins 64 are provided to connect these members. After placing the ceramic compacts 62*a*, 62*b* with another ceramic compact 62*c* interposed therebetween, the assembly is fired by a hot press at a temperature from 1650 to 1780° C. Thus the ceramic heater 60 is made.

The ceramic body 62 is constituted from the sheet-shaped ceramic compacts 62*a*, 62*b*, 62*c* placed one on another. The ceramic body 62 is preferably formed from silicon nitride ceramics similarly to the third embodiment. Thermal expansion coefficient of the ceramic body 62 can be made proximate to the thermal expansion coefficient of the heat generating resistor 63 by dispersing $MoSi_2$ or $WSi_2$ in silicon nitride that is the base material of the ceramic body 62. This improves the durability of the heat generating resistor 63.

The ceramic heater 60 of this embodiment is characterized in that the ceramic 62 that contains carbon has the heat generating resistor 63 and the lead pins 64 that are connected to the heat generating resistor 63 provided inside thereof, and carbon content in the ceramic body 62 is controlled in a range from 0.5 to 2.0% by weight. By controlling in this range, it is made possible to suppress the formation of carburized layer on the surface of the lead pins 64 and obtain the ceramic heater having high durability.

Figure 18:
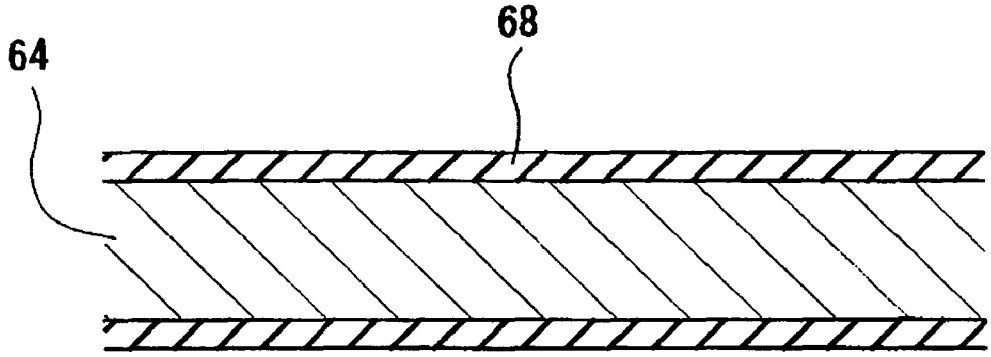
FIG. 18 is a partially enlarged sectional view of a portion near a lead pin.

Carbon is sometimes added to the ceramic body 62 for the purpose of reducing $SiO_2$ that may cause migration in the ceramic body 62. Addition of carbon makes the melting point of grain boundary layer of the ceramic body 62 higher, thereby suppressing the migration from occurring in the ceramic body 62. However, higher carbon content may cause the formation of a brittle layer 68 through carburization of the lead pin 64 on the surface thereof and make it brittle as shown in FIG. 18. The carburized layer 68 does not increase the resistance of the ceramic heater or affect the initial characteristics thereof. However, as heating operations are repeated, the lead pin 64 repeats expansion and contract eventually leading to breakage.

The inventors of the present application investigated the carbon content that can prevent $SiO_2$ contained in the ceramic body 62 from producing adverse effect, and found that the ceramic heater having high durability can be obtained when the carbon content is in a range from 0.5 to 2% by weight, for the reason described below.

When carbon content in the ceramic body 62 is lower than 0.5% by weight, concentration of $SiO_2$ that is contained as an inevitable impurity in the silicon nitride used in the ceramic body 2 becomes higher. This increases the glass layer in the grain boundary of the ceramic body 62, thus resulting in higher possibility of migration and lower durability of the ceramic heater being used at a high temperature.

When carbon content in the ceramic body 62 exceeds 2.0% by weight, although $SiO_2$ does not produce adverse effect, the metal of one kind of W, Mo, Re, etc. or a combination thereof on the surface of the lead pin 64 tends to be carburized, and mean thickness of the carburized layer 68 may exceed 80 μm. When mean thickness of the carburized layer 68 formed on the surface of the lead pin 64 exceeds 80 μm, durability of the ceramic heater 60 decreases.

Addition of carbon to the stock material of the ceramic body 62 is for the purpose of reducing $SiO_2$ that causes migration. However, addition of carbon leads to the formation of carburized layer 68 on the surface of the lead pin 64 due to thermal history of firing. Since $SiO_2$ forms the grain boundary layer in the ceramics, it accelerates the sintering process of the ceramics. However, excessive $SiO_2$ content decreases the melting point of the grain boundary layer and results in higher possibility of migration in the ceramics and lower durability of the ceramic heater. Therefore, carbon content in the ceramic body is controlled so as to decrease the $SiO_2$ content to such a level that does not affect the sintering property in this embodiment, thus making it possible to suppress migration from occurring in the ceramic body 62. At the same time, formation of carburized layer 68 on the surface of the lead pin 64 can be suppressed thereby improving durability of the ceramic heater.

Carbon content in the ceramic body 62 contains that which was brought about by carburization of the binder, in addition to the carbon that is intentionally added. Therefore, in order to control the carbon content in the ceramic body 62 in a range from 0.5 to 2.0% by weight, it is preferable to control the amount of carbon generated from the binder that is contained in the ceramic compact, as well as control the carbon added to the ceramic body 62. For controlling the amount of carbon generated from the binder, it is effective to adjust the quantity of the binder contained in the ceramic compact, change the thermal decomposition property of the binder, or control the conditions of firing the ceramic compact.

To improve the durability of the ceramic heater, it is also effective to decrease the $SiO_2$ content that is inevitably contained in the ceramic body 62. In the case of silicon nitride ceramics, the $SiO_2$ content can be decreased by applying pressure in two stages in the hot press process, with the initial pressure being set to 5 to 15 MPa followed by application of a pressure in a range from 20 to 60 MPa, while changing the temperature to 1100 to 1500° C. during the process of increasing the pressure, which turns $SiO_2$ into SiO that evaporates easily, thereby decreasing the content of $SiO_2$.

Durability of the ceramic heater 60 can be improved by controlling the diameter of the lead pin 64 to 0.5 mm or smaller and mean thickness of the carburized layer 68 formed on the surface of the lead pin 64 to 80 μm or smaller. When the diameter of the lead pin 64 is larger than 0.5 mm, the lead pin 64 is subjected to stress fatigue during thermal cycle due to the difference in thermal expansion coefficient between the ceramic body 62 and the lead pin 64, thus resulting in deterioration of durability. The diameter of the lead pin 64 is more preferably 0.35 mm or smaller. Minimum diameter of the lead pin 64 is determined by the proportion of resistance between the heat generating resistor 63 and the lead pin 64. Resistance of the lead pin 64 is preferably not higher than one fifth, more preferably one tenth of the resistance of the heat generating resistor 63, so that heat is generated selectively in the portion of heat generating resistor 63 of the ceramic heater 60. When a mean thickness of the carburized layer 8 formed on the surface of the lead pin 64 exceeds 80 μm, durability of the ceramic heater decreases due to thermal cycle during use. Mean thickness of the carburized layer 68 formed on the surface of the lead pin 64 is preferably 20 μm or larger.

It is also preferable to control the crystal grain size of the lead pin 64 to 30 μm or smaller, which makes it possible to suppress the growth of cracks that occur in the lead pin 64 during operation of the ceramic heater. When the crystal grain size of the lead pin 64 exceeds 30 μm, growth of cracks becomes faster which should be avoided. Crystal grain size of the lead pin 64 is more preferably 20 μm or smaller. In order to control the crystal grain size of the lead pin 64 to 30 μm or smaller, it is necessary to reduce the impurities such as Na, Ca, S and O contained in the ceramic body. Na, in particular, should be controlled preferably to 500 ppm or less. To control the crystal grain size of the lead pin 64, it is effective to adjust the quantity of the sintering assisting agent contained in the ceramic body, or change the firing temperature. When such manufacturing conditions are employed as to control the crystal grain size of the lead pin to 1 μm or smaller, sintering of the heat generating resistor 63 does not proceed thus resulting in lower durability contrary to the intention.

It is also preferable to keep the temperature of the lead pin 64 to 1200° C. or lower during operation of the ceramic heater. Temperature of the lead pin 64 is more preferably kept to 1100° C. or lower. By keeping the temperature of the portion near the lead pin 64 lower, thermal stress of the lead pin 64 is decreased and durability of the ceramic heater is improved.

While the heat generating resistor 63 may be formed from a material that contains carbide, nitride or silicate of W, Mo or Ti, among these, WC is particularly suited as the material to form the heat generating resistor 3 in view of thermal expansion, heat resistance and specific resistance. The heat generating resistor 63 is preferably formed from a material that contains WC that is an electrically conductive inorganic material as the main component and 4% by weight or more BN. The electrically conductive material that makes the heat generating resistor 63 has a higher thermal expansion coefficient than the silicon nitride has, and is therefore normally subjected to tensile stress while being embedded in the silicon nitride ceramics. BN, in contrast, has a lower thermal expansion coefficient than the silicon nitride has, and has low reactivity with the electrically conductive component of the heat generating resistor 63. Therefore, BN is advantageously used to mitigate the stress generated due to the difference in thermal expansion coefficient during heating and cooling of the ceramic heater. BN content higher than 20% by weight makes the resistance unstable. BN content in the heat generating resistor 63 is preferably controlled in a range from 4 to 12% by weight. 10 to 40% by weight of silicon nitride may also be added instead of BN to the heat generating resistor 63.

Figure 19:
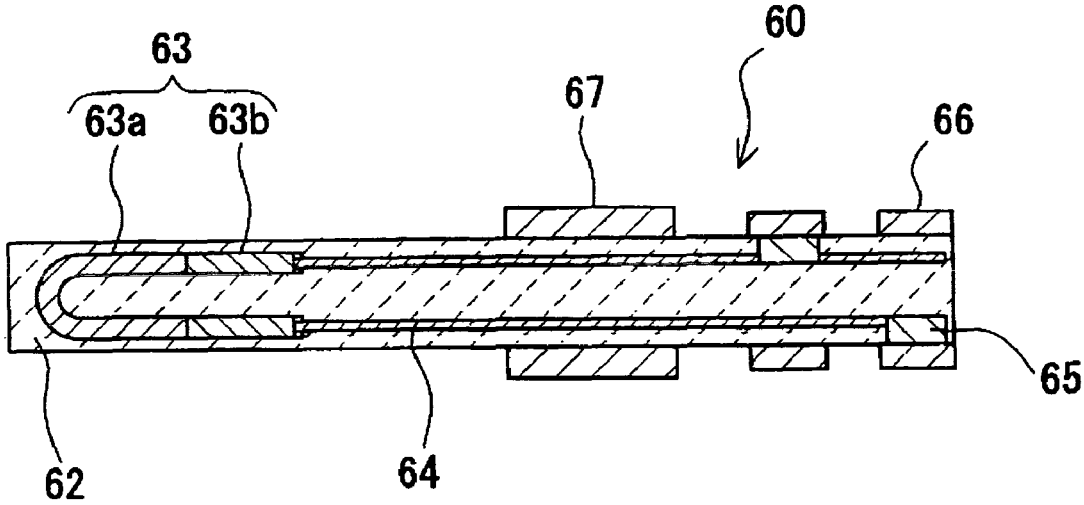
FIG. 19 is a sectional view showing the ceramic heater according to the fourth embodiment of the present invention.

The heat generating resistor 63 may also be constituted from a first heat generating resistor 63*a* that is a main heat source and a second heat generating resistor 63*b* that is connected to the lead pin 4 and has resistance lower than that of the first heat generating resistor 63*a* for the purpose of lowering the temperature of the junction, as shown in FIG. 19. In the case of the ceramic heater shown in FIG. 19, the first heat generating resistor 63*a*, the second heat generating resistor 63*b*, the lead pin 64 and the electrode lead-out section 65 are embedded in the ceramic body 62. The electrode lead-out section 65 is connected via a brazing material that is not shown in the drawing to an electrode fixture 66. A holding fixture 67 is also brazed for the purpose of securing onto equipment that uses the ceramic heater 60.

The first through fifth embodiments have been described taking examples in ceramic heaters having particular shapes such as cylinder, plate, etc. However, the ceramic heater described in a particular embodiment may have a shape described in other embodiment. In this embodiment, a method for manufacturing the ceramic heater that has cylindrical shape will be described in detail.

First, the ceramic sheet 3 is made. A ceramic powder is prepared from $Al_2O_3$ as the main component with proper quantities of $SiO_2$, CaO, MgO and $ZrO_2$ added. The powder is mixed with an organic binder in an organic solvent to make a slurry, which is formed into a sheet by doctor blade process. The ceramic sheet is cut into proper size. For the major component of the ceramic powder, any ceramics may be used such as mullite, spinel or other alumina-like ceramics, as long as it has high strength at high temperatures. Boron oxide ($B_2O_3$) may be mixed as a sintering assisting agent. The materials may be mixed in any form other than oxide as long as predetermined meshed structure can be formed. For example, the materials may be mixed in the form of various salts such as carbonate, or in the form of hydroxide.

Then a paste of metal that has a high melting point consisting of a metal of one kind from among W, Mo and Re is screen-printed with a thickness of 10 to 30 μm onto the surface of the ceramic sheet 3, so as to form the heat generating resistor 4 and the lead-out section 5. At this time, the heat generating resistor 4 and the lead-out section 5 are disposed in the longitudinal direction of the ceramic sheet 3.

Then a paste of metal that has a high melting point is screen-printed with a thickness of 10 to 30 μm to form the electrode pad 7 on the back surface of the ceramic sheet 3 at a position corresponding to the lead-out section 5 formed on the front surface. Then the through hole 6 is formed in the ceramic sheet 3 for the electrical connection of the lead-out section 5 and the electrode pad 7, with the through hole 6 filled in with a paste of metal that has a high melting point.

The paste of metal that has a high melting point is prepared by using tungsten (W), molybdenum (Mo), rhenium (Re) or other metal of high melting point. The material used to make the heat generating resistor 4 may also contain an oxide or the like of the same material as the ceramic sheet 3, as long as it does not have an adverse effect. The heat generating resistor 4, the lead-out section 5 and the electrode pad 7 may be formed by a method other than printing of paste such as chemical plating, CVD (chemical vapor deposition) or PVD (physical vapor deposition).

The ceramic core member 2 is formed from the ceramic powder. Specifically, the ceramic powder is mixed with a solvent, 1% of methyl cellulose used as the binder, 15% of Microcrystalline Wax (product name) and 10% of water. After kneading, the paste is formed into tubular shape by extrusion molding and is cut into predetermined size. The compact is fired at a temperature from 1000 to 1250° C., thereby making the ceramic core member 2.

The method of winding the ceramic sheet 3 around the ceramic core member 2 will now be described.

A ceramic cover is applied to the surface of the ceramic sheet 3 whereon the heat generating resistor 4 and the lead-out section 5 are formed, and the ceramic core member 2 is placed thereon. At this time, one ceramic core member 2 is placed on the ceramic sheet 3 so that the ceramic core member 2 is disposed parallel to the longitudinal direction of the ceramic sheet 3. An operator rolls the ceramic core member 2 with hands so as to wind the ceramic sheet 3 around the ceramic core member 2.

Figure 20A:
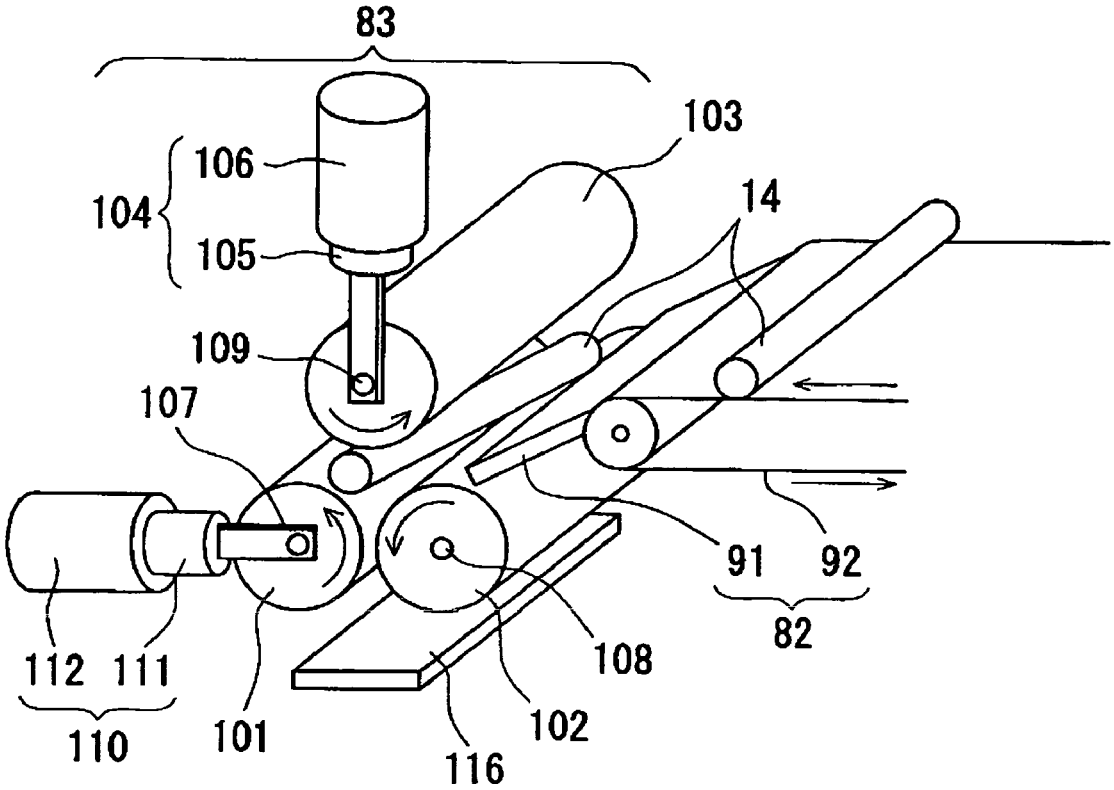
FIG. 20A is a perspective view showing a roller tightening device.

The roller apparatus used to tighten the ceramic sheet 3 around the ceramic core member 2 will now be described. FIG. 20A is a perspective view explanatory of the structure of the roller apparatus used to tighten the ceramic sheet 3. The roller apparatus comprises a set of rollers 83 and a transfer device 82. The ceramic compact 14 that has been wound is carried by a belt conveyor 92 to a sloped plate 91 and drops between a lower roller 101 and a lower roller 102. A roller shaft 109 of an upper roller 103 receives an urging force applied in the direction of the centers of a roller shaft 107 and a roller shaft 108 by a pneumatic piston 105 of an urging device 104. As the lower roller 102 that is provided with a drive mechanism rotates under this condition, the ceramic compact 14 is pressed by the circumferential surfaces of the lower roller 101, lower roller 102 and upper roller 103 to rotate. As a result, the ceramic sheet 2 is wound tightly around the ceramic core member 3.

Figure 20B:
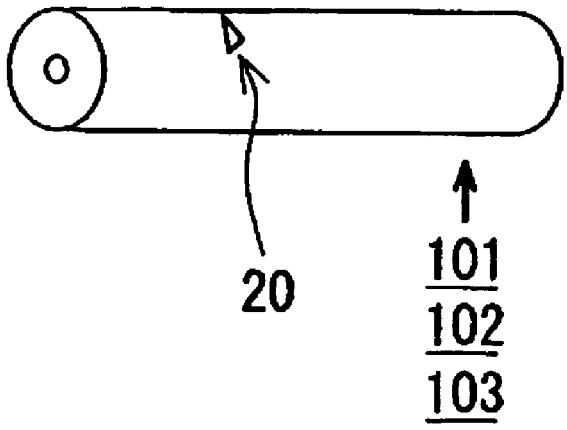
FIG. 20B is a schematic diagram showing a scratched roller of the roller tightening device.
Figure 20C:
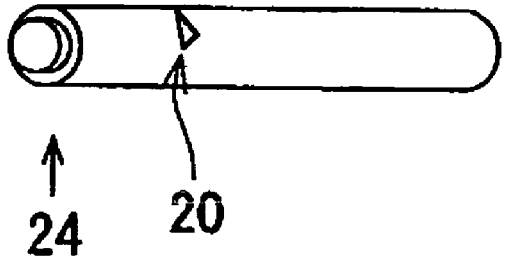
FIG. 20C is a schematic diagram showing a scratched ceramic compact.

With this tightening method, however, the ceramic compact 14 may be supplied in a posture not parallel to the two lower rollers 101 and 102, when the ceramic compact 14 is placed between the two parallel lower rollers 101 and 102 and is caused to rotate under the pressure of the upper roller 103. When rotated under such a condition, the upper and lower rollers may receive a scratch 20 as shown in FIG. 20B. When the roller having the scratch is used in tightening operation, the scratch 20 is transferred onto the surface of the ceramic compact 14 thus making a defect as shown in FIG. 20C.

Figure 21:
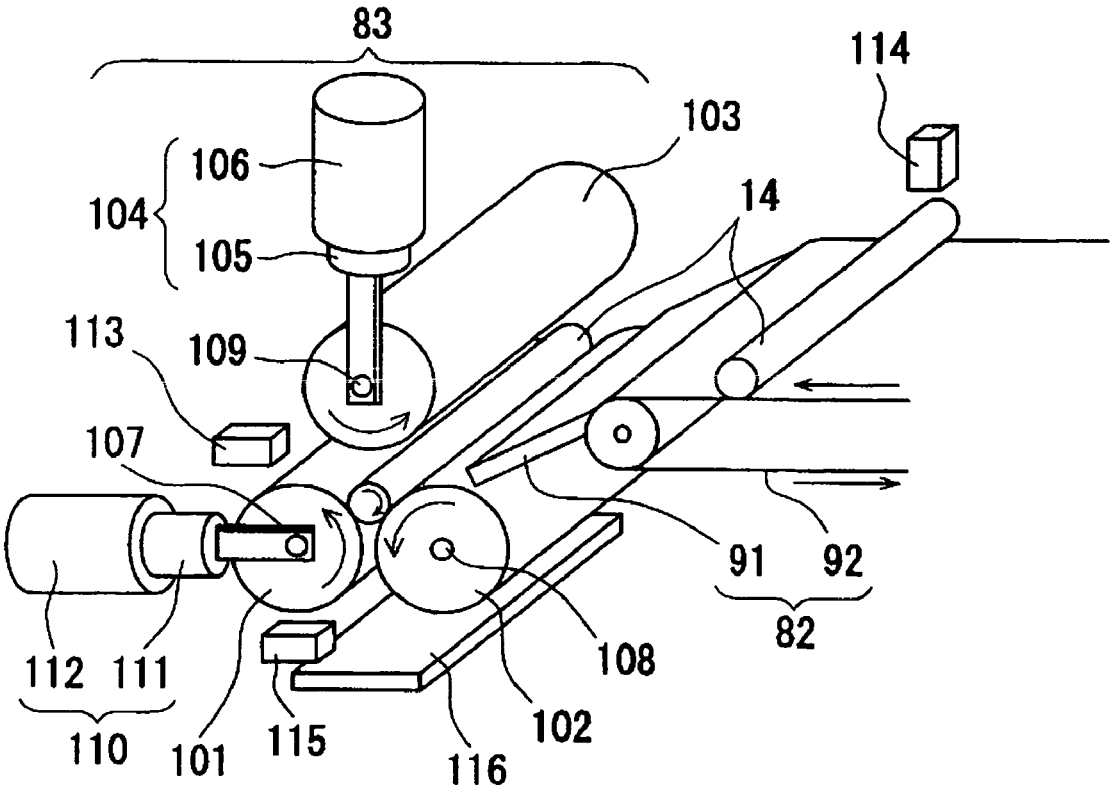
FIG. 21 is a perspective view showing another example of roller tightening device.

Therefore, instead of the apparatus shown in FIG. 20A, such a tightening apparatus as shown in FIG. 21 may be used. In the tightening apparatus shown in FIG. 21, the ceramic compact 14 is pressed by the upper roller 103 so as to rotate and tighten the ceramic sheet 2 around the ceramic core member 3, after supplying the ceramic compact 14 having the ceramic sheet 3 wound thereon to the position between the two rotating lower rollers 101 and 102 and aligning the ceramic compact 14 parallel to the lower roller 101 and the lower roller 102. This prevents the ceramic compact 14 from being placed on the lower rollers 101 and 102 in an oblique posture thereby scratching the surfaces of the lower rollers 101 and 102 when the ceramic compact 14 is pressed by the upper roller 103.

An apparatus shown in FIG. 21 has such a constitution as the transfer device 82 and the tightening device 83 are provided. The transfer device 82 is constituted from the sloped plate 91, the belt conveyor 92 and a feed sensor 114. The tightening device 83 comprises the lower roller 101, the lower roller 102, the upper roller 103, the urging devices 104, 110, an upper roller bottom dead point sensor 113, a pickup sensor 115 and a pickup table 116. The urging devices 104, 110 that apply the urging force comprise pneumatic pistons 105, 111 and pneumatic cylinders 106, 112. The pneumatic pistons 105, 111 have bearings provided at the distal end thereof. The pneumatic pistons 105, 111 are connected at the rear end thereof to the pneumatic cylinders 106, 112 so as to extend and retract. The lower rollers 101, 102 and the upper roller 103 that have cylindrical shape are formed by covering an elastic material like rubber, and the three rollers have width not smaller than the length of the ceramic compact 14.

The roller shafts 107 and 108 of the lower roller 101 and the lower roller 102 are disposed horizontally at the same height and parallel to each other. The upper roller 103 is disposed horizontally at the middle position between the two lower rollers. The roller shaft 108 of the lower roller 102 is rotatable, while the roller shaft 108 is disposed at a fixed position. The roller shaft 107 of the lower roller 101 is connected to the bearing that is provided at the distal end of the pneumatic piston 111 so as to be rotatable. As the pneumatic piston 110 extends, the roller shaft 107 receives an urging force in the direction (indicated with arrow A in FIG. 22) of the roller shaft 108. At the same time, the roller shaft 109 of the upper roller 103 receives an urging force in the direction (indicated with arrow B in FIG. 21) of the center of the roller shaft 107 and the roller shaft 108 as the pneumatic piston 105 extends.

The lower rollers 101, 102 and the upper roller 103 are driven to rotate in the same direction (direction of arrow C in FIG. 4) with the roller shaft 108 at the center, by a driving device (not shown) of the lower roller 102. The feed sensor 114 detects the ceramic compact 14 when it is placed on the belt conveyor 92. The pickup sensor 115 detects pickup of the ceramic compact when it is picked up onto the pickup table 116. The upper roller bottom dead point sensor 113 detects the arrival of the upper roller 103 at the bottom dead point.

Diameters of the lower rollers 101, 102 and the upper roller 103 are preferably in a range from 0.5 to 6.4 times the diameter of the ceramic compact 14. A roller having diameter smaller than 0.5 times the diameter of the ceramic compact 14 has insufficient tightening force on the ceramic compact 14. A roller having diameter larger than 6.4 times the diameter of the ceramic compact 14 has insufficient tightening force and poor workability.

Diameter of the upper roller 103, in particular, is preferably in a range from 0.5 to 2 times the diameter of the ceramic compact 14. Distance a between the two lower rollers 101 and 102 is preferably in a range of $0<a\leqq\frac{1}{2}b$ where b is the diameter of the ceramic compact 14. When a=0, the lower roller 101 and the lower roller 102 make contact with each other and cannot rotate. When $a>\frac{1}{2}b$, sufficient tightening force cannot be exerted on the ceramic compact 14.

The two lower rollers 101, 102 and the upper roller 103 preferably comprise core members made of steel and an elastic material covering the surface thereof. It is preferable that core members of the upper roller 103 and the two lower rollers 101, 102 are made of commonly used steel such as S45C or other carbon steel or stainless steel, and are covered by a rubber-like elastic material such as urethane rubber, neoprene rubber, silicone rubber, polybutadiene rubber, polystyrene rubber, polyisoprene rubber, styrene-isoprene rubber, styrene-butylene rubber, ethylene-propylene rubber, styrene-butadiene rubber or fluorine rubber.

While the rollers must be finished to such a surface roughness that does not damage the surface of the ceramic compact 14, mirror finish is not required. When mirror-finished, the surface of the ceramic compact 14 slips on the surface of the rollers, thus making it impossible to achieve the tightening effect.

The elastic material that covers the surfaces of the two lower rollers 101, 102 and the upper roller 103 has Shore hardness in a range from 20 to 80. An elastic material having Shore hardness less than 20 may cause undesirable deformation in the ceramic compact 14. An elastic material having Shore hardness higher than 80 is not capable of absorbing deformation of the ceramic compact 14, thus disabling it to achieve satisfactory winding and tightening operation.

Pressure of the upper roller 103 is preferably in a range from 0.03 to 0.5 MPa. Pressure of the upper roller 103 less than 0.03 MPa is too weak to achieve winding and tightening effect. When the pressure is higher than 0.5 MPa, surfaces of the rollers 101, 102, 103 may be damaged when pressed in such a condition as the ceramic compact 14 is not parallel to the two lower rollers 101 and 102 or two or more ceramic compacts 14 are mixed.

In the apparatus shown in FIG. 21, tightening operation is carried out as follows. First, the ceramic compact 14 constituted from the ceramic core member 2 and the ceramic sheet 3 wound thereon is supplied to the transfer device 82. As shown in FIG. 21, the ceramic compact 14 is carried by the belt conveyor 92 to the sloped plate 91 and drops therefrom between the lower roller 101 and the lower roller 102. The ceramic compact 14 is supplied from the transfer device 82 to the tightening device 83.

When the ceramic compact 14 is supplied from the transfer device 82 to the tightening device 83, it is confirmed that the ceramic compact 14 is picked up by means of the pickup sensor 115 before the next ceramic compact is supplied. This procedure prevents two or more ceramic compacts 14 from being supplied at the same time.

As shown in FIG. 21, ceramic compact 14 that has dropped between the lower roller 101 and the lower roller 102 makes contact with the circumferential surfaces of the lower roller 101 and the lower roller 102. However, the lower rollers 101, 102 and the ceramic compact 14 may not necessarily be oriented parallel to each other. By causing the lower roller 102 to rotate in one direction (indicated by arrow C in FIG. 22), the ceramic compact 14 is oriented parallel to the lower rollers 101 and 102. However, this rotating movement must be slow unless the ceramic compact 14 may be flipped out.

The roller shaft 109 of the upper roller 103 receives an urging force in the direction (indicated with arrow B) of the center of the roller shaft 107 and the roller shaft 108 by the pneumatic piston 105 of the urging device 104. Then the upper roller bottom dead point sensor 113 senses that the upper roller 103 has reached the bottom dead point. Thus it can be made sure whether the ceramic compact 14 is placed obliquely or not, and whether two or more ceramic compacts 14 are supplied at the same time or not. Thus the three rollers can be prevented from being damaged.

Figure 22:
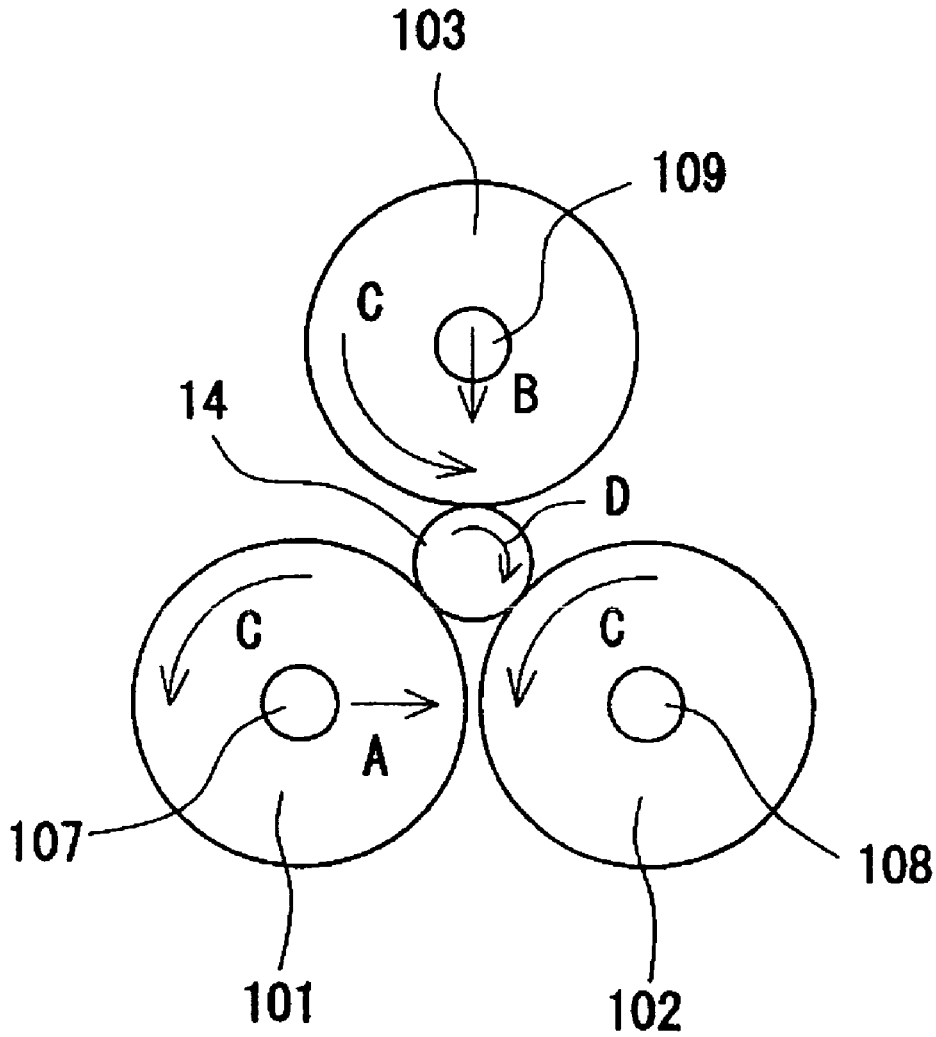
FIG. 22 is a schematic diagram showing a roller drive mechanism of the roller tightening device shown in FIG. 21.

As the lower roller 101, the lower roller 102 and the upper roller 103 rotate as shown in FIG. 22, the ceramic compact 14 is caused to rotate in the direction of arrow D while sliding over the circumferential surfaces of the lower roller 101, the lower roller 102 and the upper roller 103 so as to be pressurized thereby. As a result, the ceramic sheet 3 is wound firmly around the ceramic core member 2, so that the entire application surface of the ceramic covering layer 10 makes firm contact with the circumferential surface of the ceramic core member 2, thus completing the operation of tightening the ceramic sheet 3. At this time, it is preferable that only the lower roller 102 is driven to rotate and the lower roller 101 and the upper roller 103 rotate in liaison. This causes the three rollers to rotate at the same speed via the ceramic compact 14, thus making it possible to achieve stable and firm contact.

Then after rotating for a proper period of time, the ceramic compact 14 is knocked off from between the lower rollers 101 and 102, by the extending pneumatic pistons 111, 105 of the urging devices 110, 104 of the lower roller 101 and the upper roller 103, so as to drop onto the pickup table 116. At this time, it is made possible to prevent two or more ceramic compacts 14 from being supplied at the same time, by detecting the drop of the ceramic compacts 14 by means of the pickup sensor 115. After detecting the drop of the ceramic compacts 14 by means of the pickup sensor 115, next ceramic compact 14 is supplied. In this way, it is preferable to install the sensors on the sides of supplying and picking up the ceramic compacts 14, so as to control the number of ceramic compacts 14 that are supplied to between the lower roller 101, 102 and are picked up therefrom. Since this enables it to supply the exactly required number of ceramic compacts 14 to between the lower rollers 101, 102 and pick them up, it is made possible to reduce the time required in the tightening process and decrease the number of production tacts. It is also made possible to detect the state of two or more ceramic compacts 14 being supplied at the same time, and prevent the rollers from being damaged.

The ceramic compact 14 that has been tightened as described above is fired in a reducing atmosphere at a temperature from 1500 to 1600° C. thereby to obtain the rod-shaped ceramic heater. Then a plating layer (not shown) is formed on the surface of the electrode pad 7 by subjecting to a plating treatment (for example, nickel plating) in order to protect it from rusting, and lead wires (not shown) drawn from a power source are connected to the plating layer. The firing process may employ such methods as hot press (HP) firing, hydrostatic isotropic press (HIP) firing, controlled atmosphere pressure firing, normal atmosphere pressure firing, reactive firing or the like. The firing temperature is preferably set in a range from 1500 to 1600° C. The firing process may be carried out also in an inactive gas atmosphere (such as argon (Ar), nitrogen ($N_2$), etc.) as well as the reducing atmosphere such as hydrogen.

Example 1

The ceramic heater 1 having the structure shown in FIG. 1A and FIG. 1B was made as follows. The ceramic sheet 3 was prepared from $Al_2O_3$ used as the main component with 10% by weight in total of $SiO_2$, CaO, MgO and $ZrO_2$ being added. A paste prepared from W (tungsten) powder, a binder and a solvent was printed onto the surface of the ceramic sheet thereby to form the heat generating resistor 4 and the lead-out section 5. A variety of pastes having different values of viscosity and TI were prepared by controlling the quantities of the binder and the solvent contained in the paste. The electrode pad 7 was printed onto the back surface of the ceramic sheet. The heat generating resistor 4 was formed in a meandering pattern of 4 turnovers with heat generating length of 5 mm. The through hole 6 was formed at the end of the lead-out section 5 made of W, and the through hole was filled with a paste so as to establish electrical continuity between the electrode pad 7 and the lead-out section 5. Position of the through hole 6 was determined so as to be located within the brazed area. The ceramic sheet 3 thus prepared was wound around the ceramic core member 2 and was fired at 1600° C., thereby making the ceramic heater 1.

The ceramic heater 1 thus obtained was evaluated for durability by measuring the resistance after being subjected to 10000 heat-cool cycles, each cycle consisting of 15 seconds of heating up to 1000° C. and 1 minute of forced cooling down to 50° C. Evaluation was made on n=10 each lot. Samples that showed 15% or more change over the initial resistance were counted as wire breakage. Cross section of the heat generating resistor 4 after firing was observed under SEM on samples of n=3 each lot, so as to measure the angle ϕ of the edge 10 of the heat generating resistor.

Results of the evaluation are shown in Table 1.

TABLE 1

| No. | Viscosity (Pa · s) | TI value | Angle ϕ of the edge of cross section of the heat generating resistor (°) | Durability (Wire breakage count) | Average change in resistance (%) |
|---|---|---|---|---|---|
| 1 | 5 | 3 | 5 | 0 | 4.6 |
| 2 | 10 | 3 | 20 | 0 | 4.6 |
| 3 | 20 | 3 | 30 | 0 | 4.6 |
| 4 | 50 | 3 | 35 | 0 | 4.4 |
| 5 | 100 | 2 | 40 | 0 | 4.8 |
| 6 | 100 | 3 | 45 | 0 | 5 |
| 7 | 100 | 4 | 50 | 0 | 5 |
| 8 | 150 | 4 | 60 | 0 | 6.9 |
| 9 | 200 | 4 | 60 | 0 | 6.9 |
| *10 | 250 | 5 | 75 | 1 | 8.5 |
| *11 | 300 | 4 | 80 | 1 | 12.1 |

As can be seen from Table 1, change of 15% or more in resistance indicating wire breakage occurred in samples Nos. 10 and 11 that had angle ϕ exceeding 60°. In samples Nos. 1 through 9 that had angle ϕ not larger than 60°, satisfactory durability was demonstrated without wire breakage. It was found that in order to keep the angle ϕ of the edge 10 of the heat generating resistor within 60°, it is preferable to control the viscosity of the paste to 200 Pa·s or lower, and control the value of TI to 4 or lower.

Example 2

The proportion of metal contained in the heat generating resistor 4 and change in resistance after quick heating test were compared among the samples made in Example 1. Samples of heat generating resistor paste containing different quantities of alumina dispersed therein were prepared, and 30 pieces of ceramic heater 1 were made for each proportion of a metal component in the heat generating resistor. The proportion of a metal component was determined for each lot by observing the cross sections of 3 heat generating resistors 4 from each lot, and measuring the proportion of a metal component therein by means of an image analyzer.

10 pieces of the ceramic heater 1 from each lot were subjected to durability test of continuously heating to 1100° C. for 500 hours and 1000 cycles of heating test, each cycle consisting of 15 seconds of heating up to 1100° C. and 1 minute of forced cooling down to 50° C. Changes in resistance after the test were averaged, with the results shown in Table 2.

TABLE 2

| No. | Proportion (%) of metal in heat generating resistor | Change (%) in resistance after continuous energization durability test | Change (%) in resistance after cycle test |
|---|---|---|---|
| 1 | 25 | 18 | 25 |
| 2 | 30 | 9 | 9 |
| 3 | 40 | 8 | 8 |
| 4 | 55 | 6 | 7 |
| 5 | 70 | 7 | 7 |
| 6 | 85 | 6 | 9 |
| 7 | 95 | 6 | 9 |
| 8 | 98 | 5 | 11 |

As can be seen from Table 2, sample No. 1 of which heat generating resistor 4 contained less than 30% of a metal component showed more than 10% of change in resistance after continuous energization test at 1100° C. and heating cycle test. Sample No. 8 of which heat generating resistor contained more than 95% of a metal component showed more than 10% of change in resistance after the cycle test. Samples Nos. 2 through 7 where the proportion of metal was in a range from 30 to 95% showed satisfactory durability. Samples Nos. 3 through 5 where the proportion of metal was in a range from 40 to 70% showed satisfactory results in both continuous energization test and the heating cycle test.

Example 3

The ceramic heater having the structure shown in FIG. 7A, FIG. 7B and FIG. 8 was made as follows. The ceramic sheet was prepared from $Al_2O_3$ used as the main component with 10% by weight in total of $SiO_2$, CaO, MgO and $ZrO_2$ added thereto. The ceramic sheet was cut to predetermined size and snapped, before being fired at 1600° C. in oxidizing atmosphere to make the ceramic body 32*a*. The heat generating resistor 34 and the lead-out section 35 were formed on the surface of the ceramic body by applying a paste prepared by mixing W and glass, and was baked at 1200° C. in reducing atmosphere.

Then after trimming the heat generating resistor 34 by laser so as to control the value of resistance within 0.1Ω around a median value of 10Ω, the ceramic body 32 was divided along snap lines.

Thereafter, a glass paste was applied and fired at 1200° C. in reducing atmosphere so as to form the sealing member 33 on the heat generating resistor 34 and the lead-out section 35. After removing voids 11 from the sealing member 33, another ceramic body 32*b* was placed and fired at 1200° C. so as to integrate both pieces of the ceramic body 32 by means of the sealing member 33, thereby to obtain the ceramic heater 30 measuring 10 mm in width, 1.6 mm in thickness and 100 mm in length.

As Comparative Example, the ceramic heater having the structure shown in FIG. 1A and FIG. 1B was made as follows. The ceramic green sheet was prepared from $Al_2O_3$ used as the main component with 10% by weight in total of $SiO_2$, CaO, MgO and $ZrO_2$ added thereto. The heat generating resistor 4 made of W—Re and the lead-out section 5 made of W were formed on the front surface, and the electrode pad 7 was formed on the back surface. The heat generating resistor 4 was formed in a meandering pattern of 4 turnovers with heat generating length of 5 mm so as to provide resistance of 10Ω.

The through hole 6 was formed at the end of the lead-out section 5 that was made of W, and the though hole was filled with a paste so as to establish electrical continuity between the electrode pad 7 and the lead-out section 5. Position of the through hole 6 was determined so as to be located within the brazed area. The ceramic green sheet 3 thus prepared was wound around the ceramic core member 2 and fired at a temperature from 1500 to 1600° C., thereby making the ceramic heater 1.

Values of resistance of the ceramic heaters 30, 1 made as described above were measured on 100 samples each, and variations in the resistance were compared. Continuous energization durability test was conducted at 800° C. for 1000 hours. The results are shown in Table 3.

TABLE 3

| | Variation in resistance (%) | σ | Change (%) in resistance after durability test |
|---|---|---|---|
| Present invention | ±1 | 0.077 | 1.2 |
| Comparative Example | ±3.5 | 0.29 | 1.1 |

As can be seen from Table 3, the ceramic heater of this Example showed variation of resistance within ±1% with σ of 0.077Ω, while the ceramic heater of the Comparative Example showed variation of resistance within ±3.5% with σ of 0.58Ω, indicating that variation in resistance can be kept small with the ceramic heater 1 of the Example. In the continuous energization durability test conducted at 800° C., both samples showed satisfactory durability with variation of resistance within 1%.

Example 4

In Example 4, relationship between void ratio of the sealing member 33 and durability was studied.

The ceramic heater shown in FIG. 7A, FIG. 7B and FIG. 8 was made as follows. The ceramic sheet was prepared from $Al_2O_3$ as the main component with 10% by weight in total of $SiO_2$, CaO, MgO and $ZrO_2$ added thereto. The ceramic sheet was cut to predetermined size and snapped, before being fired at 1600° C. in oxidizing atmosphere to make the ceramic body 32. The heat generating resistor 34 and the lead-out section 35 were formed on the surface of the ceramic body 32 by applying a paste prepared by mixing W and glass, and baked at 1200° C. in reducing atmosphere. The ceramic body 32 was divided along snap lines.

A glass paste was then applied and fired at 1200° C. in reducing atmosphere so as to form the sealing member 33 on the heat generating resistor 34 and the lead-out section 35. After removing voids 11 from the sealing member 33, the assembly with another ceramic body 2 placed thereon was fired at 1200° C. in reducing atmosphere so as to integrate both pieces of the ceramic bodies 32 by means of the sealing member 33, thereby to obtain the ceramic heater 30 measuring 10 mm in width, 1.6 mm in thickness and 100 mm in length.

15 samples were made for each lot by adjusting the flatness of the sealing member 33 and the ceramic body 32 placed thereon, and adjusting the conditions of heat treatment conducted to remove voids from the sealing member 33 before bonding. Void ratio in the sealing member 33 was measured on three samples from each lot. 10 samples from each lot were subjected to 100 cycles of cooling test, each cycle consisting of heating to 700° C. and cooling down from 700° C. to 40° C. or lower in 60 seconds or shorter period of time. Then the sealing member 33 was checked to see whether cracks occurred. Results of the tests are shown in Table 4.

TABLE 4

| No. | Void ratio (%) | Number of cracks |
|---|---|---|
| 1 | 3 | 0 |
| 2 | 12 | 0 |
| 3 | 19 | 0 |
| 4 | 25 | 0 |
| 5 | 30 | 0 |
| 6 | 40 | 1 |
| 7 | 48 | 6 |

As can be seen from Table 4, samples Nos. 1 through 6 of which void ratio was 40% or less showed satisfactory durability with 1 or no cracks. Samples Nos. 1 through 5 of which void ratio was 30% or less, in particular, showed no cracks.

Example 5

The ceramic heater shown in FIG. 7A, FIG. 7B and FIG. 8 was made as follows. The ceramic sheet was prepared from $Al_2O_3$ as the main component with 10% by weight in total of $SiO_2$, CaO, MgO and $ZrO_2$ added. The ceramic sheet was cut to predetermined size and snapped, before being fired at 1600° C. in oxidizing atmosphere to make the ceramic body 32. The heat generating resistor 34 and the lead-out section 35 were formed on the surface of the ceramic body 32 by applying a paste prepared by mixing W and glass, and fired at 1200° C. in reducing atmosphere. The ceramic body 32 was divided along snap lines.

A glass paste was applied and fired at 1200° C. in reducing atmosphere so as to form the sealing member 33 on the heat generating resistor 34 and the lead-out section 35. After removing voids 11 from the sealing member 33, another ceramic body 32 was placed and fired at 1200° C. so as to integrate both pieces of the ceramic body 32 by means of the sealing member 33, thereby to obtain the ceramic heater 30 measuring 10 mm in width, 1.6 mm in thickness and 100 mm in length.

Thermal expansion coefficient of the glass used in the sealing member 33 was varied so that difference thereof from the thermal expansion coefficient of alumina ($7.3\times10^{-7}$/° C.) in temperature range from 40 to 500° C. varied in a range from 0.05 to $1.2\times10^{-5}$/C. 20 samples were made for each lot.

The ceramic heater 30 thus obtained was subjected to 3000 cycles of thermal test, each cycle consisting of heating to 700° C. in 45 seconds and cooling down to 40° C. or lower by air cooling in 2 minutes. Then the sealing member 33 was checked to see whether cracks occurred. Results of the rests are shown in Table 5.

TABLE 5

| No. | Difference in thermal expansion coefficient between ceramic body and glass × $10^{-5}$/° C. | Number of cracks after durability test |
|---|---|---|
| 1* | 1.2 | 20 |
| 2 | 1.0 | 6 |
| 3 | 0.5 | 3 |
| 4 | 0.2 | 1 |
| 5 | 0.1 | 0 |
| 6 | 0.05 | 0 |

Sample marked with * is out of the scope of the invention.

As can be seen from Table 5, cracks occurred in all samples of the sealing member 33 in sample No. 1 where difference in thermal expansion coefficient between the glass used in the sealing member 33 and the ceramic body 32 was $1.2\times10^{-5}$/° C. after about 100 cycles. Samples Nos. 2 through 6 where the difference in thermal expansion coefficient was $1.0\times10^{-5}$/° C. showed satisfactory durability with 6 or less cracks. Samples Nos. 5 and 6 where the difference in thermal expansion coefficient was $0.1\times10^{-5}$/° C. showed no cracks at all. Sample No. 4 where the difference in thermal expansion coefficient was $0.2\times10^{-5}$/° C. showed one crack. Sample No. 3 where the difference in thermal expansion coefficient was $0.5\times10^{-5}$/° C. showed 3 cracks.

Example 6

In Example 3, thickness of the sealing member 3 was varied and effect thereof on the thermal shock during cooling was studied. Void ratio was controlled in a range from 20 to 22%. Mean thickness of the sealing member 33 was varied in a range from 3 to 1200 μm by varying the number of times of printing the glass. 15 pieces were made for each sample. For the samples of which sealing member 33 had thickness of 300 μm or larger, three projections were provided on the surface of the ceramic body 32 for the purpose of adjusting the thickness, so as to control the thickness of the sealing member 33 to the desired value. The results are shown in Table 6.

TABLE 6

| No. | Thickness of sealing member (μm) | Number of cracks |
|---|---|---|
| 1 | 3 | — |
| 2 | 5 | 0 |
| 3 | 20 | 0 |
| 4 | 120 | 0 |
| 5 | 300 | 0 |
| 6 | 500 | 0 |
| 7 | 1000 | 1 |
| 8 | 1200 | 10 |

As can be seen from Table 6, cracks occurred in all specimens in sample No. 8 of which sealing member 33 had thickness of 1200 μm. Sample No. 1 of which sealing member 33 had thickness of 3 μm showed void ratio exceeding 40%, and was therefore omitted from evaluation. Samples Nos. 2 through 7 of which sealing member 33 had thickness in a range from 5 to 1000 μm showed satisfactory characteristics with one or no crack. Samples Nos. 2 through 6 of which sealing member 33 had thickness in a range from 5 to 500 μm showed no cracks at all.

Example 7

Ceramic sheets having the structure shown in FIG. 12 were made, while varying the electric field in the space W1 between segments of the heat generating resistor 53 in a range from 160 to 100 V/mm. Change in resistance after energization durability test was measured by making the distance $W_1$ between adjacent sections of the heat generating resistor 53 on the side of higher potential difference larger and the distance $W_2$ between adjacent sections of the heat generating resistor 53 on the side of lower potential difference smaller and varying the electric field in the distance $W_1$ between adjacent sections of the heat generating resistor on the side of higher potential difference in a range from 120 to 60 V/mm.

The energization durability test was conducted by repeating 10000 cycles, each cycle consisting of supplying power to the ceramic heater, shutting down the power after maintaining the temperature at 1400° C. for 1 minute, and forcibly cooling down by means of an external cooling fan for 1 minute. The temperature was maintained at 1400° C. by applying a voltage from 140 to 160 V and controlling the resistance of the ceramic heater 1 so as to generate electric field of 160 to 60 V/mm in the space of $W_1$.

A method for manufacturing the ceramic heater will be described with reference to FIG. 12.

A sintering assisting agent made of oxide of rare earth element such as ytterbium (Yb), yttrium (Y) or erbium (Er), and an electrically conductive ceramic material such as $MoSi_2$ or WC capable of making the thermal expansion coefficient proximate to that of the heat generating resistor 3 were added to silicon nitride ($Si_3N_4$) powder, so as to prepare the ceramic material powder that was then formed into the ceramic compact 52*a* by known technique such as press molding method.

As shown in FIG. 12, a paste consisting of WC and BN as the main components was applied by printing process onto the surface of the ceramic compact 2*a* thereby forming the heat generating resistor 53, the lead member 54 and the electrode lead-out section 55 on the surface of the ceramic compact 52*a*. Then the ceramic compact 52*b* was placed in close contact to cover the members described above, and a group of several tens of the ceramic compacts 52*a*, 52*b* and plates of carbon were placed alternately one on another. The assembly was put into a mold made of carbon and fired by hot press at a temperature from 1650 to 1780° C. under a pressure of 30 to 50 MPa in reducing atmosphere. Electrode fixture 56 was brazed onto the electrode lead-out section 55 that was exposed on the surface of the sintered material, thereby to obtain the ceramic heater.

Ceramic heater having the ceramic portion measuring 2 mm in thickness, 5 mm in width and 50 mm in length was made, and electric field and change in resistance for each distances $W_1$, $W_2$ between adjacent sections of the heat generating resistor 53 under a voltage of 120 V were evaluated. Evaluation was made on 10 pieces for each level, and the measured values were averaged. The results are shown in Table 7.

TABLE 7

| No. | Electric field intensity between runs of heat generating resistor (V/mm) | Distance between patterns W1 (mm) | Distance between patterns W2 (mm) | Change in resistance (%) |
|---|---|---|---|---|
| 1* | 160 | 0.30 | 0.30 | — (Insulation breakdown) |
| 2* | 140 | 0.35 | 0.35 | — (Insulation breakdown) |
| 3 | 120 | 0.40 | 0.40 | 6.5 |
| 4 | 100 | 0.50 | 0.50 | 5.5 |

TABLE 7-continued

| No. | Electric field intensity between runs of heat generating resistor (V/mm) | Distance between patterns W1 (mm) | Distance between patterns W2 (mm) | Change in resistance (%) |
|---|---|---|---|---|
| 5 | 120 | 0.60 | 0.30 | 6.2 |
| 6 | 100 | 0.75 | 0.30 | 5.0 |
| 7 | 80 | 0.90 | 0.30 | 3.1 |
| 8 | 60 | 1.25 | 0.30 | 2.2 |

Sample marked with * is out of the scope of the invention.

As shown in Table 7, samples Nos. 1 and 2 where the heat generating resistor 53 was subjected to electric field higher than 120 V/mm experienced insulation breakdown after undergoing 1000 to 5000 cycles. In contrast, samples Nos. 3 through 8 where the heat generating resistor 53 was subjected to electric field of 120 V/mm or lower achieved stable durability. Samples Nos. 7 and 8 where the distance $W_1$ between adjacent sections of the heat generating resistor 53 on the side of higher potential difference was made larger and the distance $W_2$ between adjacent sections of the heat generating resistor on the side of lower potential difference was made smaller, with the electric field in the distance $W_1$ between adjacent sections of the heat generating resistor on the side of higher potential difference set to 80 V/mm or lower achieved particularly stable durability.

Example 8

Ceramic sheets having the structure shown in FIG. 12 were made, while varying the distance X between adjacent wires in the lead section 54 in 4 levels and varying the distance Y between the heat generating resistor 53 and the lead section 54 in a range from 0.5 to 3 mm for each level. Change in resistance after energization durability test was measured for each level. The energization durability test was conducted by repeating 30000 cycles, each cycle consisting of supplying power to the ceramic heater, shutting down the power after maintaining the temperature at 1300° C. for 1 minute, and forcibly cooling down by means of an external cooling fan for 1 minute. The temperature was maintained at 1300° C. by controlling the resistance of the ceramic heater so that the applied voltage is in a range from 190 to 210 V.

A method for manufacturing the ceramic heater will be described with reference to FIG. 11. A sintering assisting agent made of oxide of rare earth element such as ytterbium (Yb) or yttrium (Y), and an electrically conductive ceramic material such as $MoSi_2$ or WC capable of making the thermal expansion coefficient proximate to that of the heat generating resistor 3 were added to silicon nitride ($Si_3N_4$) powders so as to prepare the ceramic material powder that was formed into ceramic compact 52*a* by known technique such as press molding method. As shown in FIG. 12, a paste consisting of WC and BN as the main components was applied by printing process onto the surface of the ceramic compact 52*a* thereby to form the heat generating resistor 53, the lead member 54 and the electrode lead-out section 55 on the surface of the ceramic compact 52*a*. Then the ceramic compact 52*b* was placed in close contact to cover the members described above, and a group of several tens of the ceramic compacts 52*a*, 52*b* and plates of carbon were placed alternately one on another. The assembly was put into a cylindrical mold made of carbon and fired by hot press at a temperature from 1650 to 1780° C. under a pressure of 30 to 50 MPa in reducing atmosphere. Electrode fixture 56 was brazed onto the electrode lead-out section 55 that was exposed on the surface of the sintered material, thereby to obtain the ceramic heater.

Ceramic heater having the ceramic portion measuring 2 mm in thickness, 6 mm in width and 50 mm in length was made, and change in resistance after energization durability test was evaluated. Change in resistance was measured after 10000 cycles and after 30000 cycles. Evaluation was made on 10 pieces for each level, and the measured values were averaged. The results are shown in Table 8.

TABLE 8

| | No. | Distance X between adjacent wires in the lead section (mm) | Distance Y between the heat generating resistor and the lead section (mm) | A when $Y \geqq 3X^{-1}$ is satisfied, B when not. | Change (%) in resistance after 10000 cycles | Change (%) in resistance after 30000 cycles |
|---|---|---|---|---|---|---|
| * | 1 | 4 | 0.5 | B | Insulation breakdown | — |
| | 2 | | 1 | A | 3.2 | 6.0 |
| * | 3 | 3 | 0.5 | B | Insulation breakdown | — |
| | 4 | | 1 | A | 3.9 | 5.7 |
| * | 5 | 2 | 0.5 | B | Insulation breakdown | — |
| | 6 | | 1 | B | 4.5 | Insulation breakdown |
| | 7 | | 1.5 | A | 4.6 | 6.3 |
| | 8 | | 2 | A | 3.5 | 5.6 |
| * | 9 | 1.5 | 0.5 | B | Insulation breakdown | — |
| | 10 | | 1 | B | 4.9 | Insulation breakdown |
| | 11 | | 1.5 | B | 4.5 | Insulation breakdown |
| | 12 | | 2 | A | 4.8 | 6.2 |
| | 13 | | 3 | A | 3.6 | 5.3 |

Sample marked with * is out of the scope of the invention.

As shown in Table 8, samples Nos. 2, 4, 6, 7, 8, 10, 11, 12, 13 where distance X between adjacent wires in the lead section 54 was set in a range from 1.5 to 4 mm and distance Y between the heat generating resistor 53 and the lead section 54 was set to 1 mm or larger showed stable durability without undergoing insulation breakdown after 10000 cycles. Samples Nos. 2, 4, 7, 8, 12, 13 where distance X between adjacent wires in the lead section and distance Y between the heat generating resistor and the lead section satisfied the relation of $Y \geqq 3X^{-1}$ showed excellent durability without undergoing insulation breakdown after 30000 cycles.

Example 9

In Example 3, the second heat generating section 58 having larger cross section than the other portion of the heat generating resistor 53 was formed in a part of the heat generating resistor 53 on the side of the lead section 54 in the turnover of the heat generating resistor 53 as shown in FIG. 16. Temperature difference between the end of the heat generating resistor 53 and the end of the lead member 54, and change in resistance after energization durability test were evaluated while changing the ratio of cross sectional area of the second heat generating section 58 to that of the heat generating resistor 53. Cross sectional area of the second heat generating section 58 was adjusted by changing the width of the heat generating resistor 53. The energization durability test was conducted by repeating 50000 cycles, each cycle consisting of supplying electric power to the ceramic heater, shutting down the power after maintaining the temperature at 1300° C. for 1 minute, and forcibly cooling down by means of an external cooling fan for 1 minute. The temperature was maintained at 1300° C. by controlling the resistance of the ceramic heater so as to control the applied voltage in a range from 190 to 210 V. Evaluation was made on 10 pieces for each level, and the measured values were averaged. Distance X between adjacent wires in the lead section 4 was set to 2 mm and distance Y between the heat generating resistor 53 and the lead section 54 was fixed to 1.5 mm.

TABLE 9

| No. | Ratio of cross sectional area | Temperature difference between the end of the heat generating resistor and the end of the lead section (° C.) | Change in resistance (%) |
|---|---|---|---|
| 1 | 1.0 | 83 | Insulation breakdown |
| 2 | 1.2 | 87 | Insulation breakdown |
| 3 | 1.5 | 104 | 8.9 |
| 4 | 2.0 | 115 | 7.9 |
| 5 | 2.5 | 121 | 8.2 |

As can be seen from Table 9, in sample No. 2 where the ratio of cross sectional area was controlled to 1.2, temperature difference between the end of the heat generating resistor 53 and the end of the lead section 54 was 87° C. that was similar to the case of No. 1 where the second heat generating section 58 was not provided. Sample No. 2 showed good durability until the test cycle reached 40000 cycles, but ended in wire breakage due to insulation breakdown. In samples Nos. 3 through 5 where the ratio of cross sectional area was in a range from 1.5 to 2.5, temperature difference between the end of the heat generating resistor 53 and the end of the lead member 54 was 10000 or more, and showed stable durability without insulation breakdown.

Example 10

In this Example, residual carbon in the ceramic body was varied in a range from 0.4 to 2.5% by weight by controlling the quantity of carbon added the ceramic body in a range from 0 to 2% by weight. Change in resistance after energization durability test was measured for each case. The energization durability test was conducted by repeating 30000 cycles, each cycle consisting of supplying electric power to the ceramic heater, shutting down the power after maintaining the temperature at 1300° C. for 3 minutes, and forcibly cooling down by means of an external cooling fan for 1 minute.

Ceramic sheets having the structure shown in FIG. 17 were made as follows. A sintering assisting agent made of oxide of rare earth element such as ytterbium (Yb) or yttrium (Y), and carbon powder were added to silicon nitride ($Si_3N_4$) powder, thereby preparing the ceramic material powder. Quantity of carbon powder was varied in 5 levels. The ceramic material powder was then formed into ceramic compact 62*a* by known technique such as press molding method. As shown in FIG. 17, a paste consisting of WC and BN as the main components was applied by printing process onto the surface of the ceramic compact 62*a* thereby to form the heat generating resistor 63 and the electrode lead-out section 65. Then the lead pin 64 was attached so as to establish electrical continuity between the heat generating resistor 3 and the electrode lead-out section 5. The ceramic compact 62*b* was also prepared similarly. The two ceramic compacts 62*a* and 62*b* and the ceramic compact 62*c* which covers the former were placed one on another in close contact with each other. Then a group of several tens of the ceramic compacts 62*a*, 62*b*, 62*c* and plates of carbon were placed alternately one on another. The assembly was put into a mold made of carbon and fired by hot press at a temperature from 1650 to 1780° C. under a pressure of 45 MPa in reducing atmosphere. The sintered material thus obtained was machined into cylindrical shape, and an electrode fixture 66 was brazed onto the electrode lead-out section 65 that was exposed on the surface. A holding fixture 67 was brazed onto the ceramic heater for the purpose of mounting. Ceramic portion of the sample made as described above measured 4.2 mm in diameter and 40 mm in length. Durability in energization was evaluated for each sample. Evaluation was made on 10 pieces for each level, and the measured values were averaged. Carbon content in the ceramic body 62 was determined from the quantity of $CO_2$ generated when a powder obtained by crushing the ceramic body 62 was burned. Results of the test are shown in Table 10.

TABLE 10

| No. | Addition of carbon (% by weight) | Carbon content after firing (% by weight) | Thickness of carburized layer (μm) | Change in resistance (%) |
|---|---|---|---|---|
| 1* | 0 | 0.4 | 14 | 12.0 |
| 2 | 0.2 | 0.6 | 32 | 4.9 |
| 3 | 0.5 | 0.9 | 40 | 3.8 |
| 4 | 1.0 | 1.4 | 55 | 4.6 |
| 5 | 1.5 | 1.9 | 70 | 5.5 |
| 6* | 2 | 2.5 | 105 | 23.0 |

Sample marked with * is out of the scope of the invention.

As shown in Table 10, sample No. 1 where addition of carbon was 0% showed 0.4% by weight of residual carbon in the ceramic body 2. In sample No. 1, although the lead pin 64 had a thin carburized layer of 14 μm, change in resistance after energization durability test exceeded 10%. This change in resistance took place in the heat generating section, and was caused by migration. In sample No. 6, where 2% of carbon was added, because the lead pin 64 had a thick carburized layer, a large change in resistance occurred after energization durability test, and wire breakage occurred in the lead pin 64 in some of them. In samples Nos. 2 through 5, in contrast, where 0.5 to 2.0% by weight of carbon remained in the ceramic body 62, the carburized layer was relatively thin and stable durability was achieved.

Example 11

In this Example, thickness of the reaction layer 68 of the lad pin 64 was changed in a range from 40 to 93 μm by varying the diameter of the lead pin 64 of the ceramic heater of Example 10 as 0.3 mm, 0.35 mm, 0.4 mm, 0.5 mm and 0.6 mm. Change in resistance after energization durability test was evaluated in each case. Thickness of the carburized layer was measured by cutting the ceramic heater at a position including the lead pin 64 after firing, and observing the cross section of the lead pin 64 under SEM. Thickness of the carburized layer was measured on 20 pieces for each level, and energization durability was evaluated by measuring on 10 pieces and averaging the data. In the energization durability test, evaluation was made as follows for the durability of the ceramic heater during use at high temperatures. With the heating temperature of Example 10 changed to 1500° C., the sample was subjected to 10000 cycles, each cycle consisting of 3 minutes of heating, maintaining the temperature for 1 minute and forcible air cooling by means of a fan, while measuring the properties before and after the test. The results are shown in Table 11.

TABLE 11

| No. | Diameter of lead pin (mm) | Thickness of reaction layer (μm) | Change in resistance (%) |
|---|---|---|---|
| 1 | 0.3 | 40 | 2.1 |
| 2 | 0.3 | 70 | 2.3 |
| 3 | 0.3 | 78 | 3.9 |
| 4 | 0.3 | 93 | 6.4 |
| 5 | 0.35 | 65 | 2.2 |
| 6 | 0.4 | 68 | 2.8 |
| 7 | 0.5 | 61 | 2.9 |
| 8 | 0.5 | 85 | 5.8 |
| 9 | 0.6 | 65 | 7.9. |

As can be seen from Table 11, in sample No. 4 where the lead pin 64 had diameter of 0.3 mm and the carburized layer 68 was 93 μm in thickness, change in resistance after energization durability test exceeded 5%. In sample No. 9 where the lead pin 64 had diameter of 0.5 mm and the carburized layer 8 was 85 μm in thickness and sample No. 10 where the lead pin 64 had diameter of 0.6 mm and the carburized layer 8 was 65 μm in thickness, change in resistance after energization durability test exceeded 5%. In samples Nos. 1 through 4 and Nos. 6 through 8 where the lead pin 64 had diameter of 0.5 μm or less and the carburized layer 68 was 80 μm or less in thickness, change in resistance after energization durability test showed satisfactory values of less than 5%.

Example 12

Change in resistance after energization durability test was measured while varying the crystal grain size of the lead pin of the ceramic heater of Example 10. Crystal grain size of the lead pin was varied by changing the firing temperature and the content of Na remaining in the ceramic body 62. Energization durability test was conducted by repeating 30000 cycles, each cycle consisting of supplying electric power to the ceramic heater, shutting down the power after maintaining the temperature at 1300° C. for 3 minutes, and forcibly cooling down by means of an external cooling fan for 1 minute. Crystal grain size of the lead pin 64 was measured by etching a cross section of the ceramic body 62 that contained the lead pin 64 in an etching solution and observing the surface under a metallurgical microscope. The results are shown in Table 12.

TABLE 12

| No. | Firing temperature (° C.) | Na content after firing (ppm) | Crystal grain size (μm) | Change in resistance (%) |
|---|---|---|---|---|
| 1* | 1640 | 10 | 0.8 | 17.8 |
| 2 | 1710 | 80 | 3.8 | 4.9 |
| 3 | 1710 | 200 | 9.2 | 4.8 |
| 4 | 1750 | 480 | 19.8 | 6.2 |
| 5 | 1750 | 900 | 27.0 | 8.6 |
| 6* | 1770 | 1200 | 34.5 | 23.9 |

Sample marked with * is out of the scope of the invention.

As can be seen from Table 12, in sample No. 1 where crystal grain size of the lead pin was set to 0.8 μm, change in resistance after energization durability test exceeded 10%. Change in resistance occurred in the heat generating section. In sample No. 6 where crystal grain size of the lead pin 64 was set to 34.5 μm, change in resistance exceeded 10%. Change in resistance occurred in the lead pin. In samples No. 2 through 5 where crystal grain size was set in a range from 1 to 30 μm, change in resistance after durability test showed satisfactory values less than 10%.

Example 13

In this Example, ceramic heaters having cylindrical shape were made by using the tightening apparatuses shown in FIG. 20A and FIG. 21.

First, ceramic sheet 3 that was wound around the ceramic core member 2 of the ceramic compact 14 was tightened by using the tightening apparatus shown in FIG. 20A. The ceramic compact 14 supplied between the two lower rollers 101, 102 was sometimes disposed in a posture not parallel to the two rollers, resulting in scratches on the surface of the upper and lower rollers when rolled, with the scratches being transferred onto the ceramic compact 14 thus causing defect.

Then the ceramic sheet 3 that was wound around the ceramic core member 2 of the ceramic compact 14 was tightened by using the tightening apparatus shown in FIG. 21. The ceramic compact 14 supplied between the two rotating lower rollers was disposed parallel to the two rollers, and was rotated under pressure applied by the upper roller 103, resulting in close contact of ceramic sheet 3 around the ceramic core member 2. Thus such a situation could be avoided as the tightening operation is carried out with the ceramic compact 14 placed obliquely on the lower rollers 101 and 102. Number of scratches that were produced on one piece per 1,000 pieces when processed by the apparatus shown in FIG. 20A decreased to one per 300,000 pieces when processed by the apparatus shown in FIG. 21.

A bottom dead point sensor 113 was installed on the apparatus shown in FIG. 21 so as to detect the arrival of the upper roller at the predetermined position. This made it possible to detect such a situation as the ceramic compact 14 is placed obliquely on the two lower rollers, or two more ceramic compacts 14 are supplied. This decreased the number of scratches that were produced on the surface of the roller to zero per 1,000,000 pieces.

Then sensors were installed on the ceramic compact 14 feeding section and pickup section so as to control the number of the ceramic compacts 14 supplied onto the lower rollers and those picked up. This enabled it to supply and pick up the ceramic compacts 14 without excess or shortage. As a result, it was made possible to reduce the time required in the tightening process and reduce the number of production tacts. It is also made possible to detect the state of two or more ceramic compacts 14 being supplied at the same time, and prevent the rollers from being damaged.

Then a drive mechanism was provided to each of the lower roller 101, the lower roller 102 and the upper roller 103, and tightening operation was carried out while driving all the rollers individually. When two or more rollers were driven to rotate, defects were caused due to disparity in rotating speed and difference in the timing of starting or stopping the rotation. When only the lower roller 102 was driven by a drive mechanism while the lower roller 101 and the upper roller 103 were left to rotate freely, in contrast, stable tightening operation was made possible. This is supposedly because the three rollers could rotate at the same speed via the ceramic compact 14.

Then the tightening operation was carried out while changing the diameter of the rollers of the apparatus shown in FIG. 21, with the results shown in Table 13.

TABLE 13

| Sample No. | Diameter of lower roller (mm) | Diameter of upper roller (mm) | Diameter ratio of lower roller to ceramic compact | Diameter ratio of upper roller to ceramic compact | Tightening force (N) |
|---|---|---|---|---|---|
| 1 | 3 | 3 | 0.3 | 0.3 | 15.3 |
| 2 | 3 | 5 | 0.3 | 0.5 | 17.2 |
| 3 | 5 | 3 | 0.5 | 0.3 | 18.2 |
| 4 | 5 | 5 | 0.5 | 0.5 | 30.1 |
| 5 | 10 | 10 | 1 | 1 | 31.8 |
| 6 | 20 | 20 | 2 | 2 | 32.2 |
| 7 | 30 | 30 | 3 | 2 | 31.3 |
| 8 | 40 | 40 | 4 | 2 | 31.5 |
| 9 | 50 | 50 | 5 | 2 | 33.8 |
| 10 | 60 | 60 | 6 | 2 | 34.7 |
| 11 | 64 | 64 | 6.4 | 2 | 35.2 |
| 12 | 70 | 70 | 7 | 3 | 5.6 |
| 13 | 80 | 80 | 8 | 3 | 3.3 |

As shown in table 13, in samples Nos. 1 through 3 where the ratio of diameter of upper or lower roller to the diameter of the ceramic compact 14 was less than 0.5, the force of tightening the ceramic compact 14 decreased. In samples Nos. 12, 13 where diameter of the lower roller was larger than 6.4 times the diameter of the ceramic compact 14, the tightening force decreased. When diameter of the upper roller 103 was larger than 2 times the diameter of the ceramic compact 14, the tightening force decreased. In samples Nos. 4 through 11 where diameter of the lower roller was from 0.5 to 6.4 times and diameter of the upper roller 103 was from 0.5 to 2 times the diameter of the ceramic compact 14, high tightening force could be obtained. Thus it can be seen that diameter of the lower rollers is preferably in a range from 0.5 to 6.4 times and diameter of the upper roller is preferably in a range from 0.5 to 2 times the diameter of the ceramic compact 9.

Then test was conducted while changing the distance between the lower roller 101 and the lower roller 102. Results of the test are shown in Table 14.

TABLE 14

| Sample No. | Distance a (mm) between lower rollers 101, 102 | Diameter b (mm) of roller | Ratio of distance between lower rollers 101, 102 to roller diameter | Tightening strength (N) |
|---|---|---|---|---|
| 1 | 0 | 10 | 0 | 8.2 |
| 2 | 1 | 10 | 0.1 | 31.2 |

TABLE 14-continued

| Sample No. | Distance a (mm) between lower rollers 101, 102 | Diameter b (mm) of roller | Ratio of distance between lower rollers 101, 102 to roller diameter | Tightening strength (N) |
|---|---|---|---|---|
| 3 | 2 | 10 | 0.2 | 32.3 |
| 4 | 3 | 10 | 0.3 | 31.6 |
| 5 | 4 | 10 | 0.4 | 32.3 |
| 6 | 5 | 10 | 0.5 | 31.1 |
| 7 | 6 | 10 | 0.6 | 22.4 |
| 8 | 7 | 10 | 0.7 | 21.1 |

As shown in Table 14, in sample No. 1 where distance a (mm) between the lower rollers 101, 102 was 0 for the diameter b of the ceramic compact 14, the lower roller 101 and the lower roller 102 make contact with each other and cannot rotate. In samples Nos. 7, 8 where a>½b, the tightening force on the ceramic compact 14 decreased. In samples Nos. 2 through 6 where distance between the lower rollers satisfied a relation of 0<a≦½b, stable tightening force was obtained. From these results, it can be seen that the distance a between the two lower rollers and diameter b of the ceramic compact 14 preferably satisfy the relation of 0<a≦½b.

Then test was conducted while changing the material and hardness of the lower rollers 101, 102 and the upper roller 103. Results of the test are shown in Table 15.

TABLE 15

| Sample No. | Material of lower rollers 101, 102 and upper roller 103 | Shore hardness of elastic material | Tightening strength (N) |
|---|---|---|---|
| 1 | Steel | | 12.3 |
| 2 | Elastic material | 10 | 20.9 |
| 3 | Elastic material | 20 | 33.2 |
| 4 | Elastic material | 30 | 32.8 |
| 5 | Elastic material | 40 | 31.5 |
| 6 | Elastic material | 50 | 31.1 |
| 7 | Elastic material | 60 | 32.5 |
| 8 | Elastic material | 70 | 31.5 |
| 9 | Elastic material | 80 | 31.7 |
| 10 | Elastic material | 90 | 25.3 |

As shown in Table 15, sample No. 1 where the rollers were made of steel, deformation of the ceramic compact 14 cannot be absorbed and the tightening force becomes low. Even when an elastic material was used, sample No. 2 where material having Shore hardness lower than 20 was used achieved a low tightening force. Sample No. 10 where material having Shore hardness higher than 80 was used also achieved a low tightening force. In samples Nos. 3 through 9 where the two lower rollers 101, 102 and the upper roller 103 were covered by an elastic material on the surface thereof and materials having Shore hardness in a range from 20 to 80 were used, stable tightening strength was obtained. From these results, it can be seen that it is preferable to cover the two lower rollers and the upper roller 103 by an elastic material on the surface thereof and use a material having Shore hardness in a range from 20 to 80.

Then test was conducted while changing the pressure of the upper roller 103. Results of the test are shown in Table 16.

TABLE 16

| Sample No. | Pressure of upper roller (MPa) | Tightening strength (N) |
|---|---|---|
| 1 | 0.01 | 22.1 |
| 2 | 0.03 | 32.1 |
| 3 | 0.05 | 31.2 |
| 4 | 0.1 | 31.1 |
| 5 | 0.2 | 32.7 |
| 6 | 0.3 | 32.3 |
| 7 | 0.4 | 32.5 |
| 8 | 0.5 | 32.5 |
| 9 | 0.6 | 31.2 |

As shown in Table 16, in sample No. 1 where pressure of the upper roller 103 was less than 0.03 MPa, tightening force was low and sufficient tightening effect could not be achieved. While sufficient tightening force was achieved in sample No. 9 where the pressure exceeded 0.5 MPa, the surfaces of the upper and lower rollers 101, 102, 103 are scratched when pressure was applied. In samples Nos. 2 through 8 where pressure of the upper roller 103 was in a range from 0.03 to 0.5 MPa, stable tightening force could be achieved. From these results, it can be seen that pressure of the upper roller 103 is preferably in range from 0.03 to 0.5 MPa.

What is claimed is:

1. A ceramic heater comprising:

a first and second elongate ceramic body; and a heat generating resistor, wherein the heat generating resistor is between the first and second elongate ceramic bodies, wherein a plurality of parts of the heat generating resistor are arranged in a longitudinal direction along boundaries between the first and second elongate ceramic bodies, each part having two sides, wherein the thickness of the heat generating resistor changes when viewed from a section perpendicular to the longitudinal direction, wherein an angle of an edge of said heat generating resistor is 60° or less between the two sides, when viewed from the section perpendicular to the longitudinal direction of said heat generating resistor.

2. The ceramic heater according to claim 1, wherein the angle of the edge of said heat generating resistor is 60° or less in a bending portion of said heat generating resistor in a plan view.

3. The ceramic heater according to claim 1, wherein the edge of said heat generating resistor has a curved surface, of which curvature radius is 0.1 mm or less.

4. The ceramic heater according to claim 1, wherein the mean thickness of said heat generating resistor at the center of the width thereof is 100 μm or less.

5. The ceramic heater according to claim 1, wherein the distance from the edge of said heat generating resistor to the surface of said ceramic heater is 50 μm or larger.

6. The ceramic heater according to claim 1, wherein the proportion of an area occupied by a metal component in the section perpendicular to the longitudinal direction of said heat generating resistor is in a range from 30 to 95%.

* * * * *